US008737869B2

(12) United States Patent
Takahashi

(10) Patent No.: US 8,737,869 B2
(45) Date of Patent: May 27, 2014

(54) IMAGE FORMING APPARATUS WITH EXPOSURE DEVICE, SUPPORT STRUCTURE SUPPORTING EXPOSURE DEVICE AND HOUSING TO STORE EXPOSURE DEVICE

(75) Inventor: Hiroki Takahashi, Osaka (JP)

(73) Assignee: Kyocera Mita Corporation (JP)

( * ) Notice: Subject to any disclaimer, the term of this patent is extended or adjusted under 35 U.S.C. 154(b) by 190 days.

(21) Appl. No.: 13/349,834

(22) Filed: Jan. 13, 2012

(65) Prior Publication Data

US 2012/0189341 A1 Jul. 26, 2012

(30) Foreign Application Priority Data

Jan. 26, 2011 (JP) ..... 2011-014303
Jan. 31, 2011 (JP) ..... 2011-018285

(51) Int. Cl.
*G03G 15/00* (2006.01)

(52) U.S. Cl.
USPC ..... 399/110

(58) Field of Classification Search
USPC ..... 399/110, 11, 113, 115; 361/790, 797
See application file for complete search history.

(56) References Cited

U.S. PATENT DOCUMENTS 5,787,323 A * 7/1998 Nomura et al. ..... 399/111
7,907,866 B2 * 3/2011 Imaizumi et al. ..... 399/90
2005/0122555 A1 6/2005 Kondoh et al.
2007/0160384 A1 7/2007 Sakurai et al.
2007/0279719 A1 * 12/2007 Miyamoto et al. ..... 359/198
2008/0007935 A1 1/2008 Kondo et al.
2010/0080615 A1 4/2010 Kikuchi
2010/0209139 A1 8/2010 Sakurai et al.
2011/0164897 A1 7/2011 Kikuchi
2012/0308264 A1 12/2012 Kikuchi
2012/0315063 A1 12/2012 Kikuchi

FOREIGN PATENT DOCUMENTS

JP 9-11541 1/1997
JP 2003-266865 9/2003
JP 2005-138442 6/2005
JP 2006-17999 1/2006
JP 2010-36446 2/2010
KR 10-2008-0041378 5/2008

* cited by examiner

*Primary Examiner* — Clayton E LaBalle
*Assistant Examiner* — Victor Verbitsky
(74) *Attorney, Agent, or Firm* — Gerald E. Hespos; Michael J. Porco; Matthew J. Hespos

(57) ABSTRACT

The present invention provides an image forming apparatus, which has an exposure device for emitting light to a charged image formation surface to form an electrostatic latent image, a support structure for supporting the exposure device, and a housing for storing the exposure device, wherein the housing has a first wall which is provided with an insertion opening to insert the support structure that supports the exposure device, and the support structure is designed so that the support structure is pulled out of the housing through the insertion opening.

16 Claims, 18 Drawing Sheets

IMAGE FORMING APPARATUS WITH EXPOSURE DEVICE, SUPPORT STRUCTURE SUPPORTING EXPOSURE DEVICE AND HOUSING TO STORE EXPOSURE DEVICE

BACKGROUND OF THE INVENTION

1. Field of the Invention

The present invention is related to an image forming apparatus for forming an electrostatic latent image by means of an exposure device.

2. Description of the Background Art

An image forming apparatuses such as a copier, a printer or a fax machine typically comprises a photosensitive drum, a charger which charges the photosensitive drum, an exposure device which irradiates the circumferential surface of the charged photosensitive drum to form an electrostatic latent image, and a developing device configured to supply toner to the circumferential surface of the photosensitive drum on which the electrostatic latent image is formed, in order to form a toner image.

The exposure device comprises various optical devices such as a light source which emits light, a mirror which defines an optical path of the light emitted from the light source, and a lens which adjusts a diameter of the light emitted from the light source. The optical devices are generally susceptible to vibrations.

In general, the exposure device susceptible to the vibrations is very accurately positioned with respect to a housing of the image forming apparatus, for example, and then firmly fixed with screws. Conventionally, the exposure device is tightly fixed so that vibrations or external forces do not change the optical settings. The conventional tight fixation of the exposure device, however, interferes with efficient maintenance works of the exposure device or equipment around the exposure device. A worker working for the maintenance has to remove the exposure device, which is fixed tightly to the housing. After the maintenance work on target equipment, the worker has to very accurately position and fix the exposure device.

SUMMARY OF THE INVENTION

An object of the present invention is to provide an image forming apparatus comprising an exposure device which allows efficient maintenance works.

An image forming apparatus according to one aspect of the present invention is an image forming apparatus for forming an image on a sheet, including: an exposure device configured to emit light to a charged image formation surface to form an electrostatic latent image; a support structure configured to support the exposure device; and a housing configured to store the exposure device, wherein the housing includes a first wall which is provided with an insertion opening to insert the support structure that supports the exposure device, and the support structure is designed so that the support structure is pulled out of the housing through the insertion opening.

The objects, features and advantages of the present invention will become apparent from the following descriptions and the accompanying drawings.

DESCRIPTION OF THE PREFERRED EMBODIMENTS

An image forming apparatus according to one embodiment is described hereinafter with reference to the accompanying drawings. It should be noted that directional terms such as "upper," "lower," "left" and "right" hereinafter simply intend to clarify the descriptions, and do not limit principles of the image forming apparatus in any way.

(Image Forming Apparatus)

Figure 1:
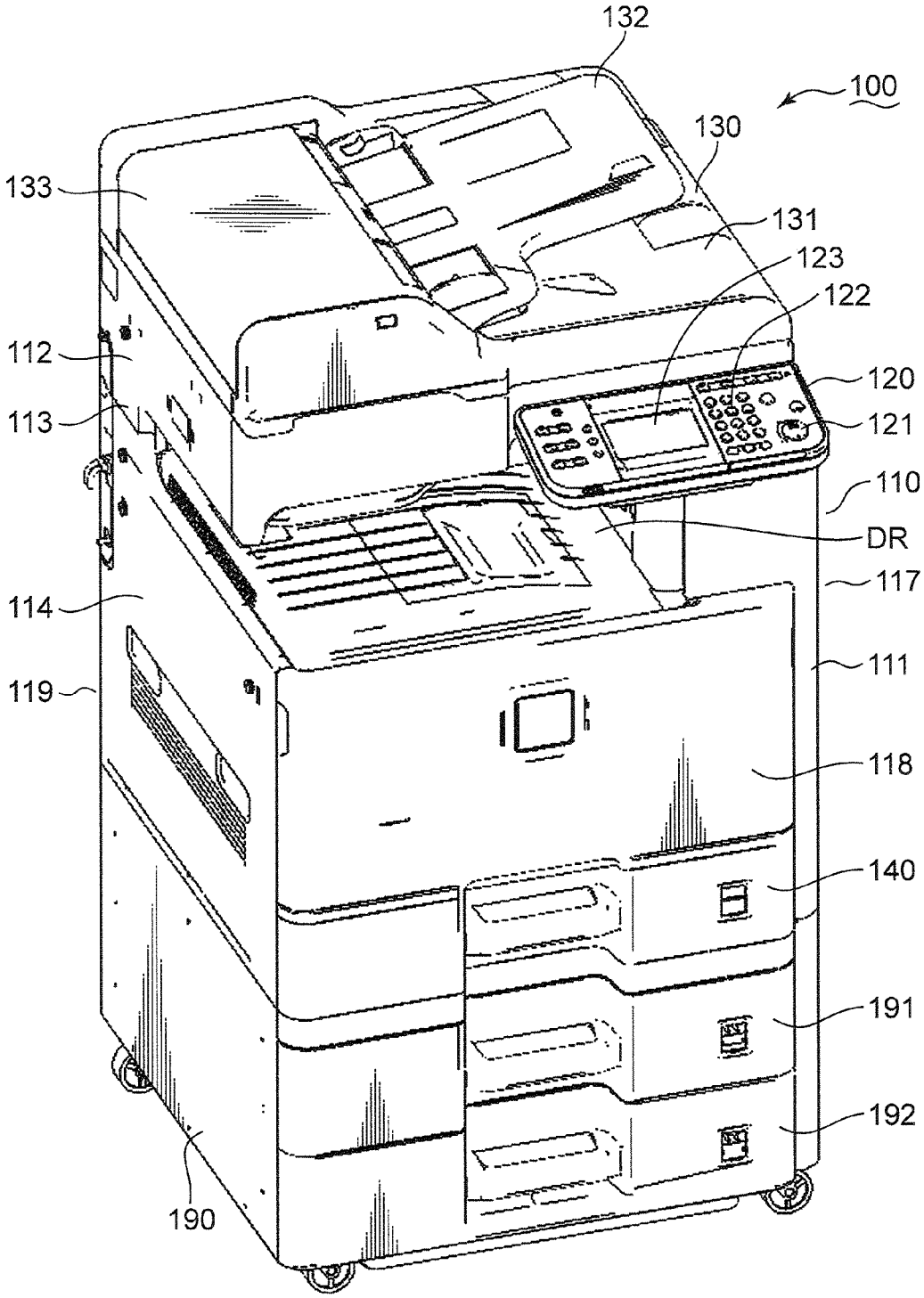
FIG. 1 is a schematic perspective view of an image forming apparatus according to one embodiment.

FIG. 1 is a perspective view of an image forming apparatus according to one embodiment. The image forming apparatus shown in FIG. 1 is a copier. Alternatively, a printer, a fax machine, a combined machine with these functions, or other device configured to form an image on a sheet may be used as the image forming apparatus.

A copier 100 comprises a housing 110 to store various devices which form images on sheets. The term "sheet" used in the descriptions of the present embodiment means ordinal paper, an OHP sheet, a cardboard, tracing paper, a postcard, or any other sheet-like material which allows toner image formation.

The housing 110 includes a lower housing 111 to store various devices which form toner images, an upper housing 112 situated above the lower housing 111, and an intermediate housing 113 situated between the lower and upper housings 111, 112. The upper housing 112 mainly stores devices configured to read an image on an original document. The intermediate housing 113 is formed along the right surface and the rear surface of the copier. Therefore, a space DR is formed between the lower and upper housings 111, 112. The intermediate housing 113 mainly stores a discharge device configured to discharge a sheet to the space DR after a copying process is performed on the sheet.

The copier 100 further comprises a console 120 attached to the upper housing 112. For example, the console 120 includes a start button 121 which is used for making the copier 100 start the copying operation, input buttons 122 which is used for inputting a number of copies and copy densities, and a display panel 123 which is used for displaying the input details to a user. The user may use the console 120 to instruct the copier 100 so that the copier 100 performs desired operations.

The copier 100 also comprises an original document feeder 130 mounted on the upper housing 112. The original document feeder 130 includes a cover element 131 lying along the upper surface of the upper housing 112, and a tray 132 mounted above the cover element 131. The tray 132 is inclined so that its right edge becomes the highest in the tray 132. The original document feeder 130 further includes a connection portion 133, which connects the cover element 131 to the tray 132, and a feed unit (not shown) which is stored in the connection portion 133.

The user may place an original document on the tray 132. If the user presses the start button 121 of the console 120, the feed unit in the connection portion 133 draws the original document on the tray 132 into the connection portion 133. The feed unit then sends the original document in between the cover element 131 and the upper housing 112. The various devices stored in the housing 112 read an image on the original document between the cover element 131 and the upper housing 112. The various devices inside the lower housing 111 form a toner image on a sheet in response to the read image data of the original document. Eventually, the sheet is discharged to the space DR by the discharge device in the intermediate housing 113.

The pivotal original document feeder 130 is connected to the upper housing 112. Optionally, the user may turn the original document feeder 130 upward. The user may thereafter place a desired original document on the upper housing 112. The user may turn the original document feeder 130 downward and press the original document placed on the upper housing 112. If the user presses the start button 121, the devices inside the upper housing 112 start reading an image on the original document.

The copier 100 also comprises a cassette 140 to store sheets. The cassette 140 is inserted into a lower portion of the lower housing 111. The various devices stored in the lower housing 111 pull out the sheets one by one which are stored in the cassette 140. The sheets are subjected to image forming processes during the conveyance inside the lower housing, and eventually discharged to the space DR. Once all of the sheets in the cassette 140 are taken out, the user may pull the cassette 140 out of the lower housing to refill the cassette 140.

Optionally, the copier 100 may comprises an additional modular conveyor 190. The modular conveyor 190 is situated below the lower housing 111. The modular conveyor 190 includes additional cassettes 191, 192. The user may operate the console 120 to choose a sheet feeder among the cassettes 140, 191 and 192.

The lower housing 111 includes an outer plate 114 which covers the left surface of the lower housing 111. The outer plate 114 may be removed from the copier 100, as appropriate.

Figure 2:
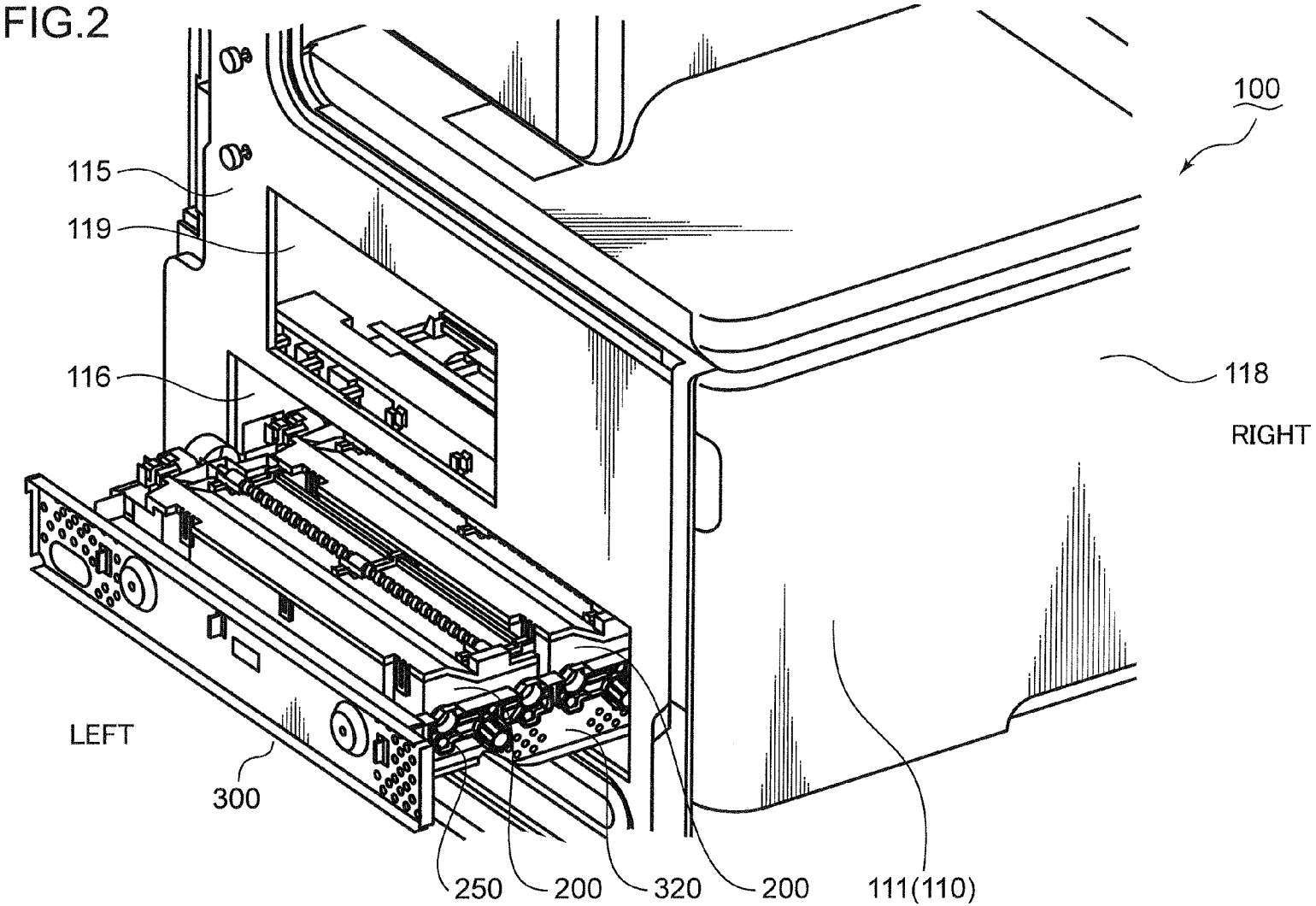
FIG. 2 is a schematic perspective view of an exposure device and a support structure supporting the exposure device, which are pulled out of a housing of the image forming apparatus shown in FIG. 1.

FIG. 2 is an enlarged perspective view of the lower housing 111 from which the outer plate 114 is removed. The copier 100 is further described with reference to FIGS. 1 and 2.

The lower housing 111 includes a left wall 115. The left wall 115 is covered by the outer plate 114 if the outer plate 114 is attached to the housing 110.

A substantially rectangular insertion opening 116 is formed in the left wall 115. In the present embodiment, the left wall 115 is exemplified as the first wall. Alternatively, the other wall of the housing 110 which forms another surface may be used as the first wall.

The copier 100 further comprises an exposure device 200 and a support frame 300 which supports the exposure device 200. The exposure device 200 emits a laser beam in response to the read image data of the original document to form an electrostatic latent image. The support frame 300 is exemplified as the support structure in the present embodiment.

After removing the outer plate 114, the user may pull out the support frame 300 to the left through the insertion opening 116. The user may pull the exposure device 200 out of the housing 110 along with the support frame 300 to easily clean, adjust, replace or repair the exposure device 200.

Thereafter, the user may insert the support frame 300, which supports the exposure device 200, into the housing 110 through the insertion opening 116. Accordingly, the exposure device 200 may be easily stored in the lower housing 111. In the present embodiment, the rightward direction is exemplified as the insertion direction.

Figure 3:
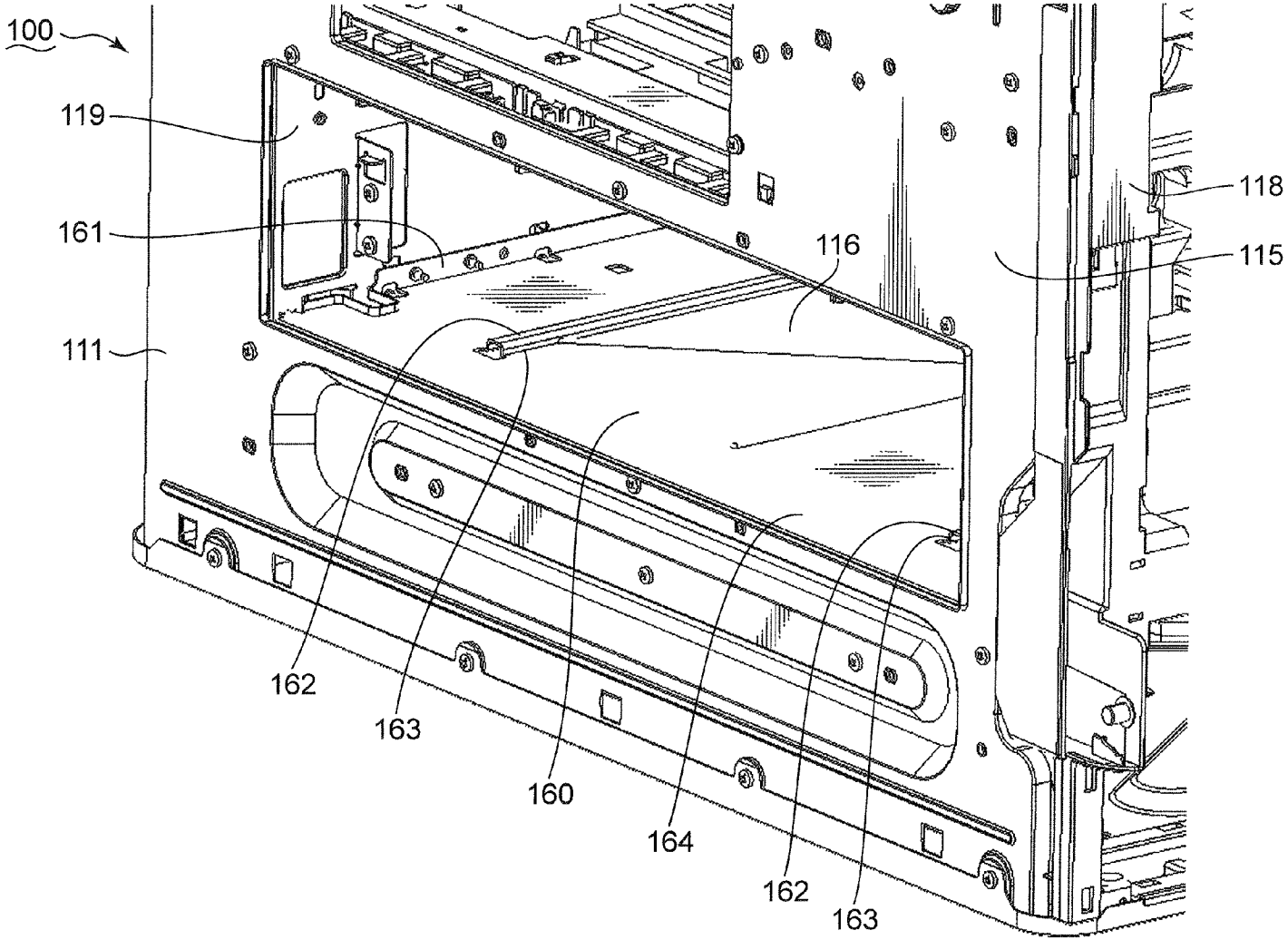
FIG. 3 is a schematic perspective view of the housing of the image forming apparatus after removal of the exposure device and the support structure shown in FIG. 2.

FIG. 3 is a schematic perspective view of the copier 100 from which the exposure device 200 and the support frame 300 are removed. The copier 100 is further described with reference to FIGS. 1 to 3.

The lower housing 111 further comprises a right wall 117 opposite to the left wall 115, a front wall 118 extending between the left and right walls 115, 117, and a back wall 119 opposite to the front wall 118. The lower housing 111 also includes a support plate 160 which includes an upper surface 164 configured to support the support frame 300 that is inserted in the lower housing 111. The support plate 160 includes peripheries 161 which are fixed to the inner surface of the left, right, front and back walls 115, 117, 118, 119, respectively. The support plate 160 also includes a pair of ribs 162 which protrudes upward. The ribs 162 extend along the insertion direction of the support frame 300 and the exposure device 200. The ribs 162 guide the support frame 300 and the exposure device 200 to move in the insertion direction and/or a pull-out direction. In the present embodiment, the upper surface 164 of the support plate 160 is exemplified as the support surface. The ribs 162 are exemplified as the rails.

Figure 4:
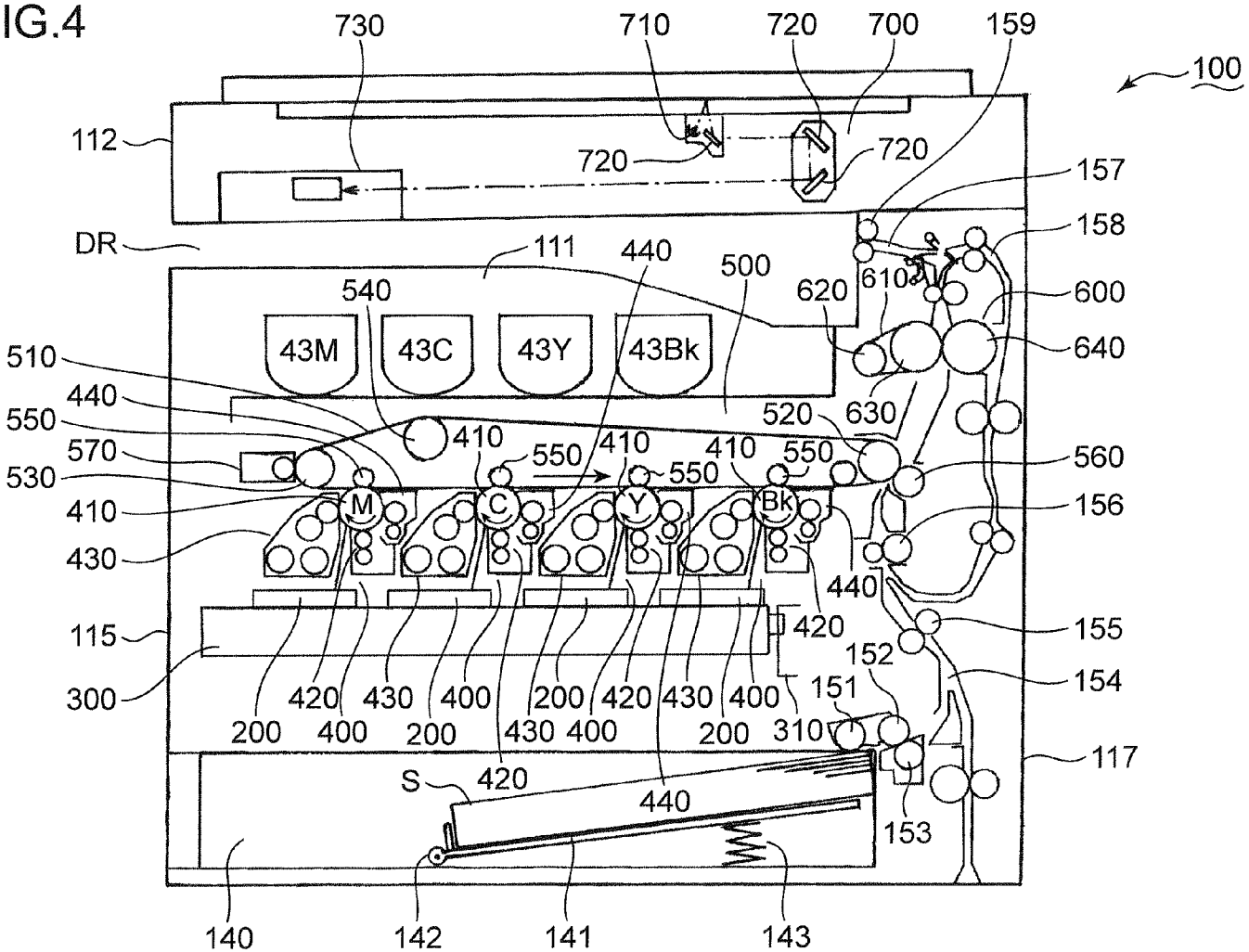
FIG. 4 is a schematic view of an internal structure of the image forming apparatus shown in FIG. 1.

FIG. 4 is a schematic view of an internal structure of the copier 100. The copier 100 is further described with reference to FIGS. 1, 2 and 4. It should be noted that the modular conveyor 190 described with reference to FIG. 1 is not shown in FIG. 4.

In the present embodiment, the support frame 300 supports four exposure devices 200. These four exposure devices 200 are separate. The four exposure devices 200 are independently mounted to the support frame 300. One of the exposure devices 200 is exemplified as the first exposure device in the present embodiment. The other exposure devices are exemplified as the second exposure device.

The copier 100 further comprises four image formation units 400 situated above the support frame 300. These four image formation units 400 correspond to the four exposure devices 200, respectively. The far-left image formation unit 400 forms an image corresponding to the magenta hue of the image on the original document. The image formation unit 400, which is adjacent to the image formation unit 400 corresponding to the magenta hue, forms an image corresponding to the cyan hue of the image on the original document. The far-right image formation unit 400 forms an image corresponding to the black hue of the image on the original document. The image formation unit 400, which is adjacent to the image formation unit 400 corresponding to the black hue, forms an image corresponding to the yellow hue of the image on the original document.

Each of the image formation units 400 comprises a substantially cylindrical photosensitive drum 410 and a charger 420 situated under the photosensitive drum 410. The charger 420 substantially uniformly charges the circumferential surface of the photosensitive drum 410. The corresponding exposure device 200 emits a laser beam to the charged circumferential surface of the photosensitive drum 410 in response to the image data of the original document, to form an electrostatic latent image. The exposure device 200, which emits a laser beam to the photosensitive drum 410 of the image formation unit 400 corresponding to the magenta hue, forms an electrostatic latent image in response to the image data corresponding to the magenta hue. The exposure device 200, which emits a laser beam to the photosensitive drum 410 of the image formation unit 400 corresponding to the cyan hue, forms an electrostatic latent image in response to the image data corresponding to the cyan hue. The exposure device 200, which emits a laser beam to the photosensitive drum 410 of the image formation unit 400 corresponding to the yellow hue, forms an electrostatic latent image in response to the image data corresponding to the yellow hue. The exposure device 200, which emits a laser beam to the photosensitive drum 410 of the image formation unit 400 corresponding to the black hue, forms an electrostatic latent image in response to the image data corresponding to the black hue. The circumferential surface s of the photosensitive drums 410 are exemplified as the image formation surfaces in the present embodiment.

Each of the image formation units 400 also comprises a developing device 430 to supply toner to the circumferential surface of the corresponding photosensitive drum 410 on which the electrostatic latent image is formed, in order to develop (make visible) the electrostatic latent image. A toner image, which is substantially coincident with the electrostatic latent image, is formed on the circumferential surface of the photosensitive drum 410 by the toner that is supplied from the developing device 430. The developing device 430 of the image formation unit corresponding to the magenta hue supplies magenta toner to the corresponding photosensitive drum 410. The developing device 430 of the image formation unit corresponding to the cyan hue supplies cyan toner to the corresponding photosensitive drum 410. The developing device 430 of the image formation unit corresponding to the yellow hue supplies yellow toner to the corresponding photosensitive drum 410. The developing device 430 of the image formation unit corresponding to the black hue supplies black toner to the corresponding photosensitive drum 410.

Each of the image formation units 400 further comprises a cleaning device 440. The cleaning device 440 removes the toner which remains on the circumferential surface of the corresponding photosensitive drum 410 after transcription of the toner image. The transcription of the toner image from each photosensitive drum 410 (primary transfer) is described hereinafter.

The circumferential surface of the photosensitive drum 410, which is cleaned by the cleaning device 440, turns toward the corresponding charger 420 again. The charger 420 charges the circumferential surface of the photosensitive drum 410 again. The corresponding exposure device 200 forms another electrostatic latent image on the charged circumferential surface of the photosensitive drum 410.

The copier 100 further comprises a toner container 43M containing the magenta toner, a toner container 43C containing the cyan toner, a toner container 43Y containing the yellow toner, and a toner container 43Bk containing the black toner. The toner container 43M supplies the toner to the developing device 430 of the image formation unit 400 corresponding to the magenta hue. The toner container 43C supplies the toner to the developing device 430 of the image formation unit 400 corresponding to the cyan hue. The toner container 43Y supplies the toner to the developing device 430 of the image formation unit 400 corresponding to the yellow hue. The toner container 43Bk supplies the toner to the developing device 430 of the image formation unit 400 corresponding to the black hue.

The copier 100 further comprises a transcription portion 500 situated between the toner containers 43M, 43C, 43Y, 43Bk and the image formation units 400. The transcription portion 500 includes a transcription belt 510 to which the toner images are transferred from the photosensitive drums 410, a driving roller 520 which drives the transcription belt 510, an idler 530 situated to the left side of the driving roller 520, and a tension roller 540 which causes tension on the transcription belt 510 between the driving roller 520 and the idler 530. The transcription belt 510 revolves around the driving roller 520, the idler 530 and the tension roller 540.

The transcription portion 500 also includes four transcription rollers 550. These four transcription rollers 550 are situated above the four photosensitive drums 410, respectively. The transcription rollers 550 and the photosensitive drums 410 sandwich the transcription belt 510 to form nip portions. The toner images are transcribed from the photosensitive drums 410 to the transcription belt 510 at these nip portions.

The magenta toner image is transcribed to the outer surface of the transcription belt 510 which passes between the photosensitive drum 410 of the image formation unit 400 corresponding to the magenta hue and the transcription roller 550. Thereafter, the cyan toner image is transcribed over the magenta toner image when the transcription belt 510 passes between the photosensitive drum 410 of the image formation unit 400 corresponding to the cyan hue and the transcription roller 550. Subsequently, the yellow toner image is transcribed over the magenta and cyan toner images when the transcription belt 510 passes between the photosensitive drum 410 of the image formation unit 400 corresponding to the yellow hue and the transcription roller 550. Finally, the black toner image is transcribed over the magenta, cyan and yellow toner images when the transcription belt 510 passes between the photosensitive drum 410 of the image formation unit 400 corresponding to the black hue and the transcription roller 550. As a result, a full-color toner image is created.

The transcription portion 500 further comprises a transcription roller 560 adjacent to the driving roller 520. If the sheet S is conveyed from the cassette 140, the sheet S passes between the driving roller 520 and the transcription roller 560. Meanwhile, the toner image formed on the transcription belt 510 is electrostatically transcribed to the sheet S, as described above.

The transcription portion 500 further comprises a cleaning device 570. The cleaning device 570 removes the toner which remains on the outer surface of the transcription belt 510 after the toner image is transcribed to the sheet S.

The cassette 140 comprises a lift plate 141 on which a stack of the sheets S is placed. A rotatable base end 142 of the lift plate 141 is attached to a side wall of the cassette 140.

The cassette 140 also comprises a biasing mechanism 143 configured to bias the lift plate 141 upward. The copier 100 further comprises a pickup roller 151 situated above the leading edges of the sheets S on the lift plate 141. If the biasing mechanism 143 lifts the tip of the lift plate 141 upward, the leading edges of the sheets S are pressed against the pickup roller 151. The sheets S are conveyed outside the cassette 140 as the pickup roller 151 rotates.

The copier 100 further comprises a feed roller 152 situated after the pickup roller 151, and a retard roller 153 adjacent to the feed roller 152. The feed roller 152 rotates to convey the sheets S further downstream. If the pickup roller 151 conveys a single sheet S from the cassette 140, the retard roller 153 is rotated by the conveyance motion of the sheet S. If the pickup roller 151 conveys several sheets S from the cassette 140, a torque limiter (not shown) of the retard roller 153 is activated to stop the retard roller 153. Therefore, the retard roller 153 causes frictional force acting against the conveyance motion of the sheets S. As a result, only the sheet S, which comes into direct contact with the feed roller 152, is conveyed further downstream. The rest of the sheets S are held before the retard roller 153. Thus, the sheets S are conveyed one by one downstream.

A feeding path 154 extending from the feed roller 152 to the transcription roller 560 is defined inside the lower housing 111. The copier 100 further comprises a pair of conveyance rollers 155 and a pair of resist rollers 156, which are situated along the feeding path 154. The sheet S conveyed downstream by the feed roller 152 is sent to the paired resist rollers 156 by the paired conveyance rollers 155. The sheet S is conveyed in between the driving roller 520 and the transcription roller 560 by the paired resist rollers 156 in synchronism with the formation of the full-color toner image on the transcription belt 510. As described above, the full-color toner image is transcribed to the sheet S between the driving roller 520 and the transcription roller 560.

The copier 100 further comprises a fixing device 600 configured to fix the toner images to the sheet S. The fixing device 600 includes a heating belt 610 which applies heat energy to the sheet S, a heating roller 620 which heats the heating belt 610, and a fixing roller 630 which works together with the heating roller 620 to drive the heating belt 610. The heating belt 610 is wound around the heating roller 620 and the fixing roller 630.

The fixing device 600 further comprises a pressure roller 640 which compresses the heating belt 610. The heating belt 610 is sandwiched between the fixing roller 630 and the pressure roller 640 to form a nip portion. While the sheet S passes through this nip portion, the toner is melted so that the toner images are fixed to the sheet S.

The conveyance path for guiding the sheet S in the downstream of the fixing device 600 bifurcates into a discharge path 157 extending toward the space DR, and a return path 158 which is curved toward the right wall 117 of the housing 110.

The copier 100 further comprises a pair of discharge rollers 159 situated at a terminal end of the discharge path 157. If the user operates the console 120 to instruct one-side printing operation, the paired discharge rollers 159 discharge the sheet S to the space DR. If the user operates the console 120 to instruct double-side printing operation, the paired discharge rollers 159 convey the sheet S to the space DR by a predetermined length, and then reversely rotate. As a result, the sheet S is conveyed to the return path 158.

The return path 158 extends downward along the right wall 117 and is then curved toward the feeding path 154. The return path 158 and the feeding path 154 meet each other immediately before the resist roller pair 156.

The sheet S is conveyed in between the driving roller 520 and the transcription roller 560 again by the paired resist rollers 156. Therefore, the images are formed on both sides of the sheet S. While the sheet S passes through the fixing device 600 again, the newly formed toner images are fixed to the sheet S. The sheet S is then discharged to the space DR by the paired discharge rollers 159.

The copier 100 also comprises a reader 700 stored in the upper housing 112. The reader 700 includes a light source 710 which emits light toward the original document set on the upper surface of the upper housing 112, several mirrors 720 which receive reflected light from the original document and define an optical path of the reflected light, and a generator 730 which converts the reflected light into electric signals to generate the image data. The aforementioned exposure device 200 scans the circumferential surface of photosensitive drum 410 with the laser beam in response to the image data generated by the generator 730.

The lower housing 111 further comprises a positioning wall 310 configured to position the support frame 300, which supports the exposure device 200. The positioning wall 310 faces the left wall 115. As described with reference to FIGS. 2 and 3, if the support frame 300 supporting the exposure device 200 is inserted into the lower housing 111 through the insertion opening 116, the positioning wall 310 engages with the support frame 300 to position the support frame 300 and the exposure device 200 with respect to the housing 110. In the present embodiment, the positioning wall 310 is exemplified as the second wall.

(Support Structure)

Figure 5:
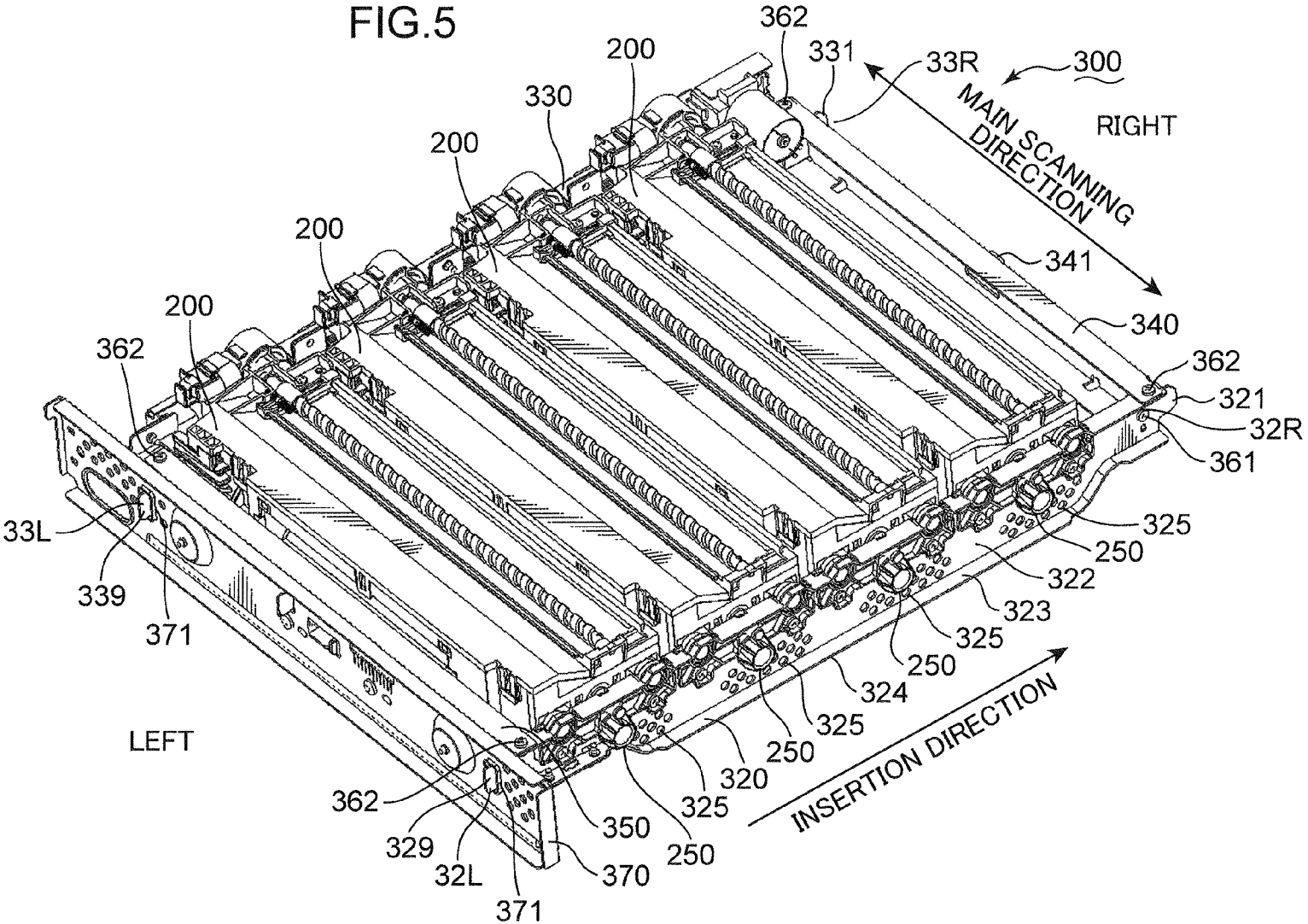
FIG. 5 is a schematic perspective view of the support structure configured to support the exposure device shown in FIG. 2.
Figure 6:
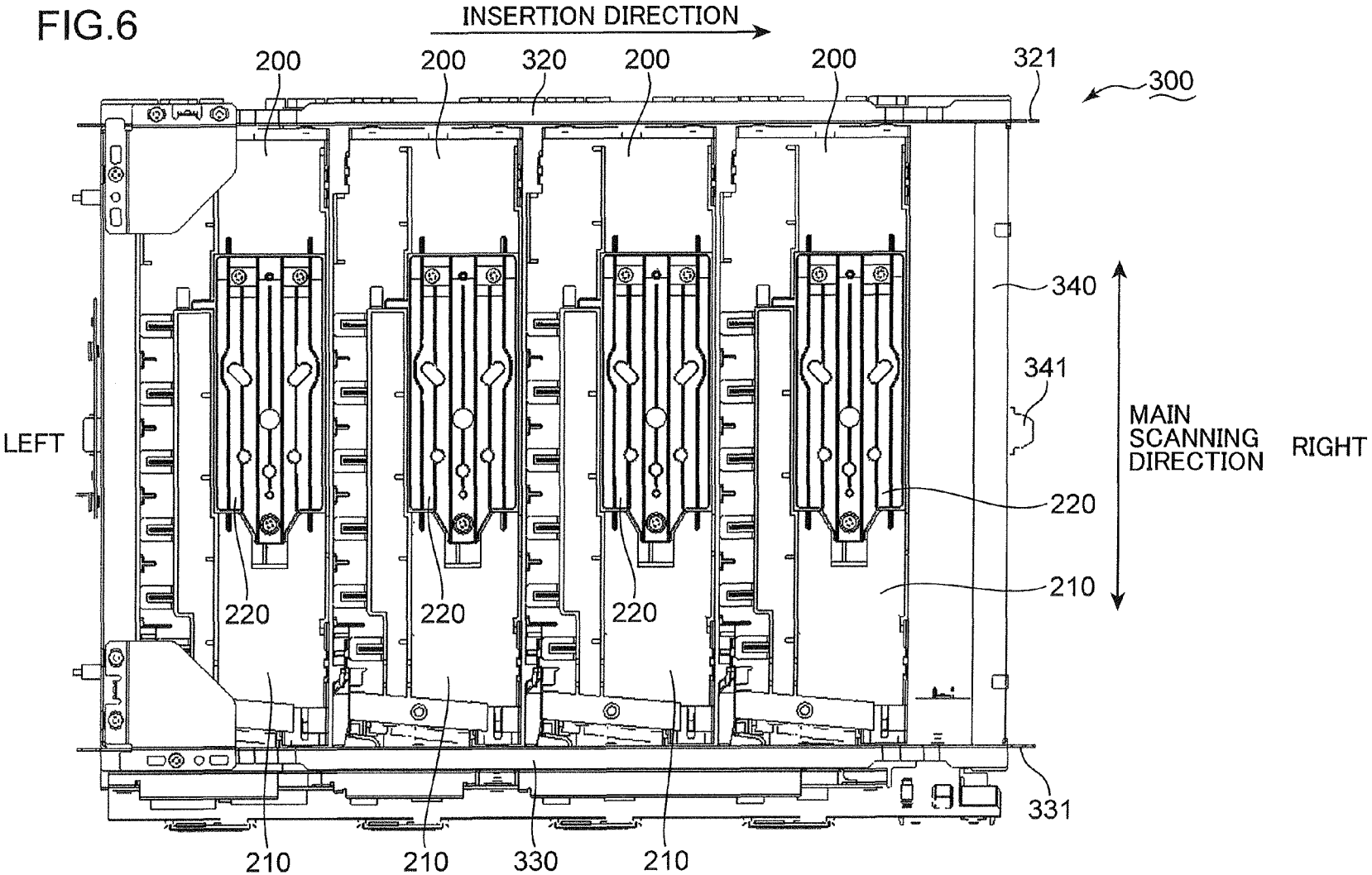
FIG. 6 is a schematic bottom view of the support structure configured to support the exposure device shown in FIG. 5.

FIG. 5 is a schematic perspective view of the support frame 300 which supports the exposure device 200. FIG. 6 is a schematic bottom view of the support frame 300 shown in FIG. 5. The support frame 300 is described with reference to FIGS. 5 and 6.

The support frame 300 comprises a first frame plate 320, which extends in the insertion direction, and a second frame plate 330 opposite to the first frame plate 320. The exposure devices 200 are placed and supported between the first and second frame plates 320, 330, respectively, which are placed substantially in parallel to each other. In the present embodiment, the direction substantially perpendicular to the insertion direction becomes the main scanning direction of the exposure devices 200.

The support frame 300 further comprises a third frame plate 340 which is connected to a right end 32R of the first frame plate 320 and a right end 33R of the second frame plate 330. The first frame plate 320 includes a vertical flap 321 which projects from the third frame plate 340 extending in the main scanning direction. Likewise, the second frame plate 330 includes a vertical flap 331 which projects from the third frame plate 340 extending in the main scanning direction. The third frame plate 340 includes a horizontal flap 341. The horizontal flap 341 projects to the right from substantially the middle of the third frame plate 340 in the longitudinal direction. The vertical flaps 321, 331 are used to position the support frame 300 in the vertical direction. The horizontal flap 341 is used to position the support frame 300 in the horizontal direction. In the present embodiment, the right ends 32R, 33R of the first and second frame plates 320, 330 are exemplified as the first ends, respectively.

Figure 7:
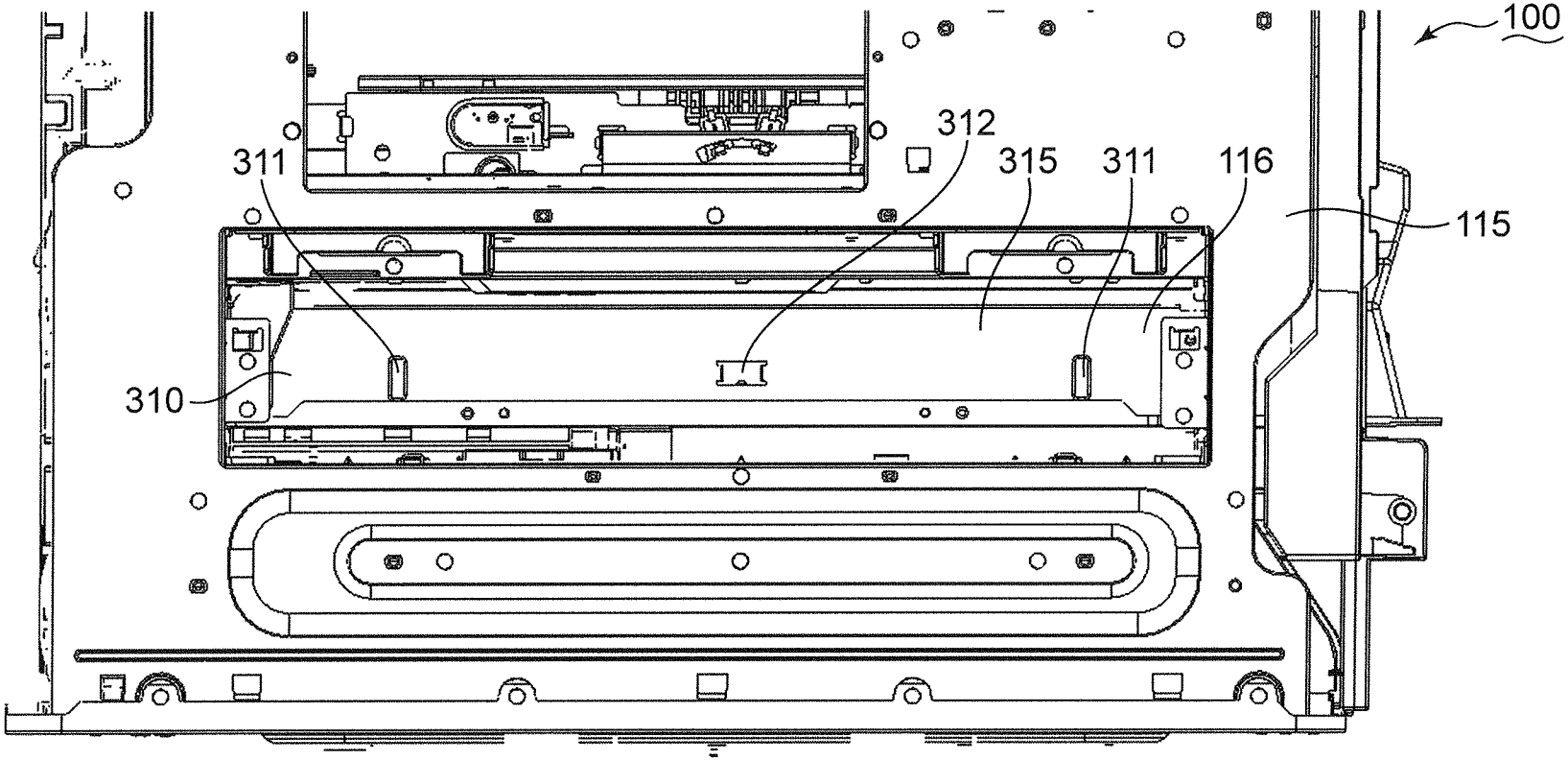
FIG. 7 is a schematic view of the internal structure of the image forming apparatus viewed from an insertion opening formed on the housing of the image forming apparatus shown in FIG. 2.

FIG. 7 shows the internal structure of the copier 100, which is viewed from the insertion opening 116 formed on the right wall 115. The support frame 300 and the exposure devices 200 are removed from the copier 100 shown in FIG. 7. The positioning wall 310 is described with reference to FIGS. 4 to 7.

The positioning wall 310 is viewed through the insertion opening 116. The positioning wall 310 includes an inner wall surface 315 which faces the support frame 300. The inner wall surface 315 is provided with paired vertical slits 311, which extend in the vertical direction, and a horizontal slit 312, which extends in the horizontal direction. The vertical slits 311 are substantially complementary to (to be substantially the same height as) cross sections of the vertical flaps 321, 331. If the support frame 300 is inserted into the lower housing 111, the vertical flaps 321, 331 are inserted into the vertical slits 311. As a result, the support frame 300 is positioned in the vertical direction. The horizontal slit 312 is substantially complementary to (to be substantially the same width as) a cross section of the horizontal flap 341. If the support frame 300 is inserted into the lower housing 111, the horizontal flap 341 is inserted into the horizontal slit 312. As a result, the support frame 300 is positioned in the horizontal direction. In the present embodiment, the vertical flaps 321, 331 at the right ends of the first and second frame plates 320, 330 are exemplified as the first positioning pieces, respectively. The paired vertical slits 311, into which the vertical flaps 321, 331 are inserted, are exemplified as the first positioning holes. The contours of the paired vertical slits 311 are exemplified as the first hole edges. The horizontal flap 341 formed on the third frame plate 340 is exemplified as the second positioning piece. In addition, the horizontal slit 312, into which the horizontal flap 341 is inserted, is exemplified as the second positioning hole.

Figure 8:
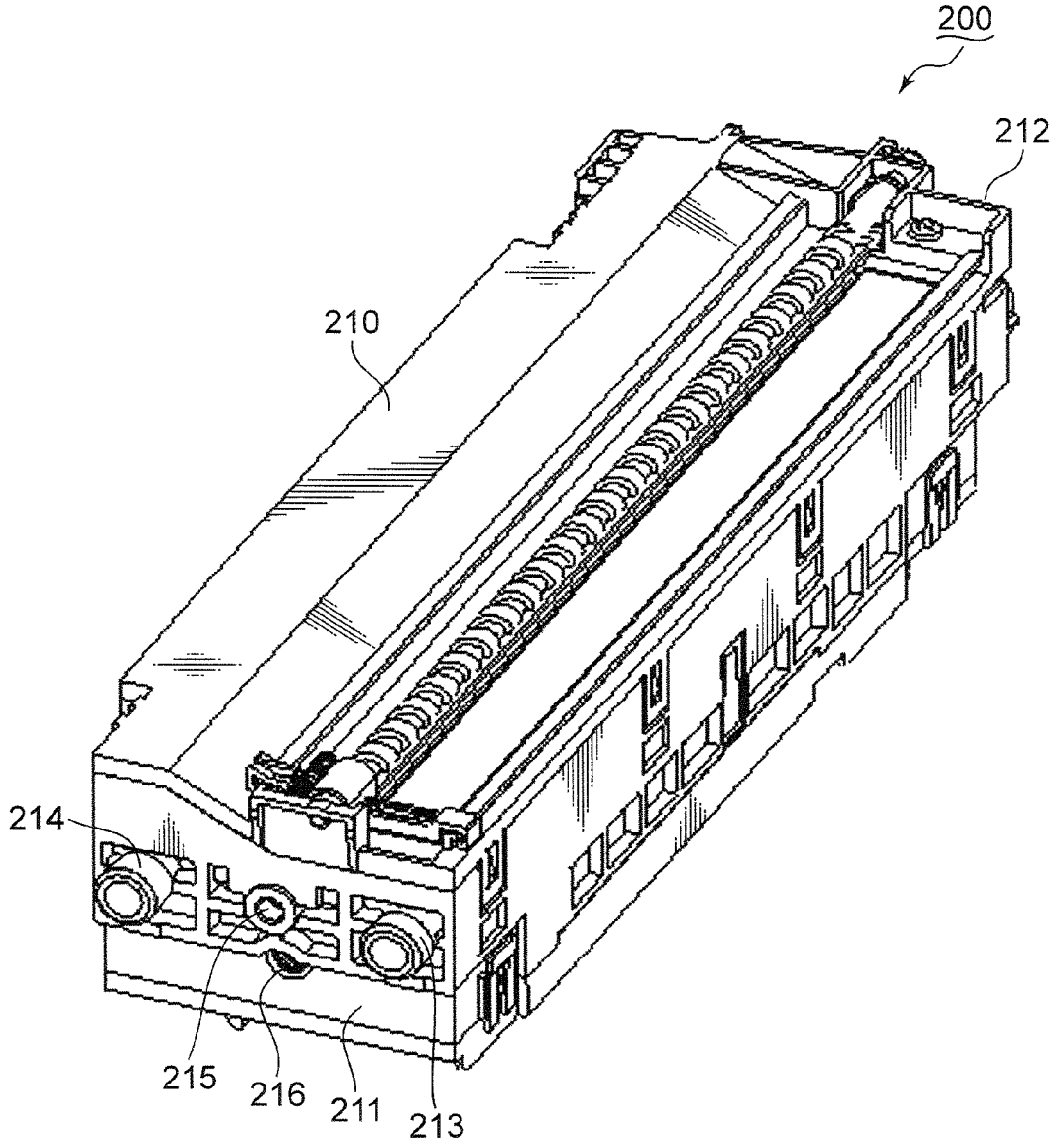
FIG. 8 is a schematic perspective view of the exposure device shown in FIG. 2.
Figure 9:
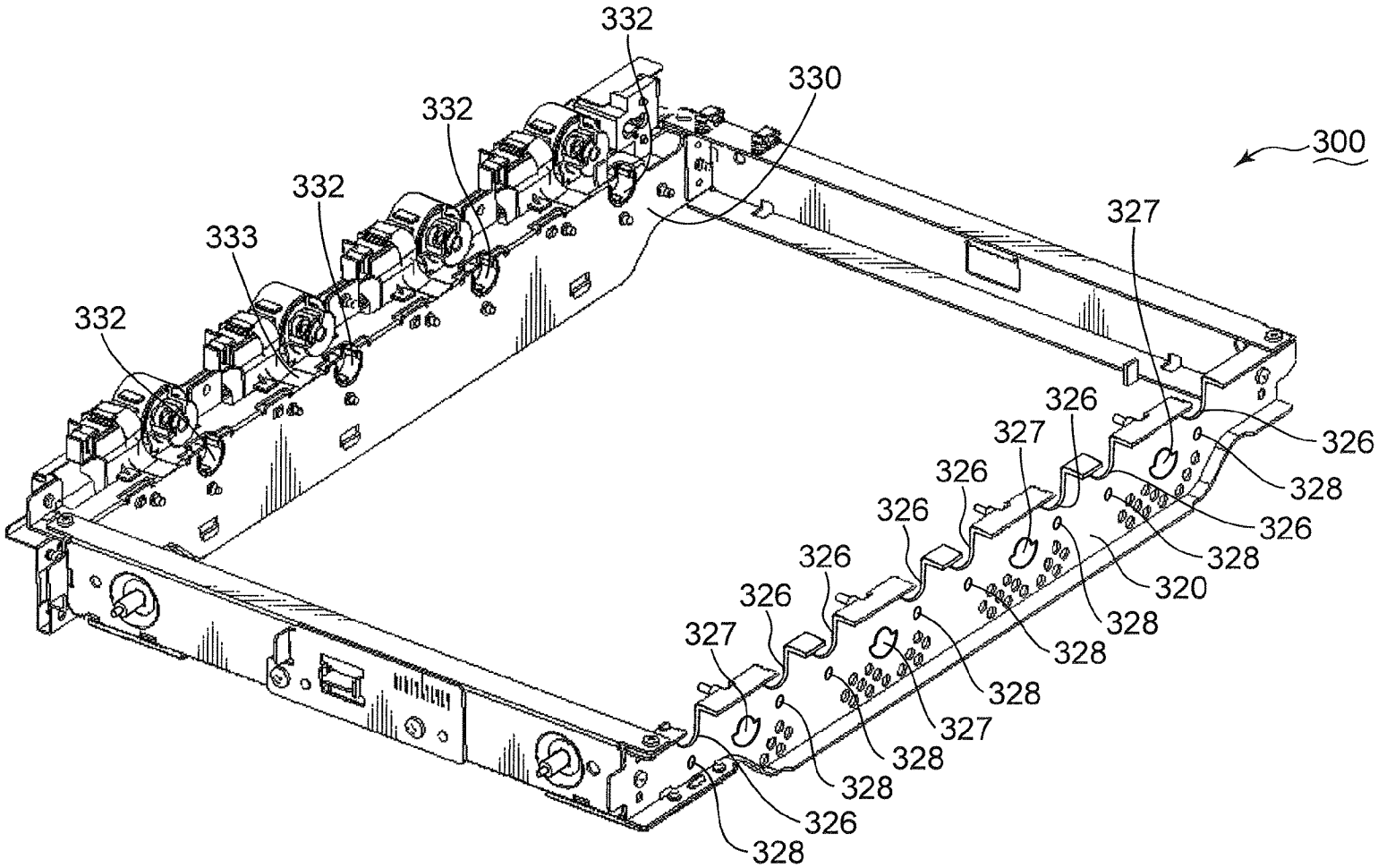
FIG. 9 is a schematic perspective view of the support structure shown in FIG. 5.

FIG. 8 is a schematic perspective view of the exposure device 200. FIG. 9 is a schematic perspective view of the support frame 300. The exposure device 200 is described with reference to FIGS. 2, 8 and 9.

The exposure device 200 comprises various optical devices (not shown), which are used for scanning the circumferential surface of the photosensitive drum 410 with the light to form an electrostatic latent image, and a housing 210, which stores the optical devices. The housing 210 includes a front wall 211 along the first frame plate 320 and a back wall 212 along the second frame plate 330. The front wall 211 includes substantially cylindrical first and second bosses 213, 214 which protrude toward the first frame plate 320. In the present embodiment, the housing 210 is exemplified as the storage box. The first and second bosses 213, 214 are exemplified as the first protrusions, respectively.

Notches 326, which are formed on the upper edge of the first frame plate 320, are complementary to the lower portions of the first and second bosses 213, 214, respectively. The first and second bosses 213, 214 are inserted into the notches 326 of the first frame plate 320. The first and second bosses 213, 214 engage with the notches 326 to support the exposure device 200 on the first frame plate 320. In the present embodiment, the notches 326 are exemplified as the first notches.

An attachment hole 215 is defined between the first and second bosses 213, 214. An opening 327 is defined in the first frame plate 320 so as to communicate with the attachment hole 215. The user may insert a suitable fixture (e.g., a screw) into the attachment hole 215 to fix the housing 210 on the first frame plate 320.

An adjustment hole 216 is formed in the front wall 211 so as to communicate with the interior of the housing 210. The opening 327 formed on the first frame plate 320 also communicates with the adjustment hole 216. The user may insert a tip of a tool into the housing 210 through the adjustment hole 216 to adjust the settings of the optical devices inside the housing 210. Accordingly, the optical settings on the four exposure devices 200 may be appropriately and individually adjusted with respect to the support frame 300, which is appropriately positioned with respect to the housing 110 of the copier 100.

Figure 10:
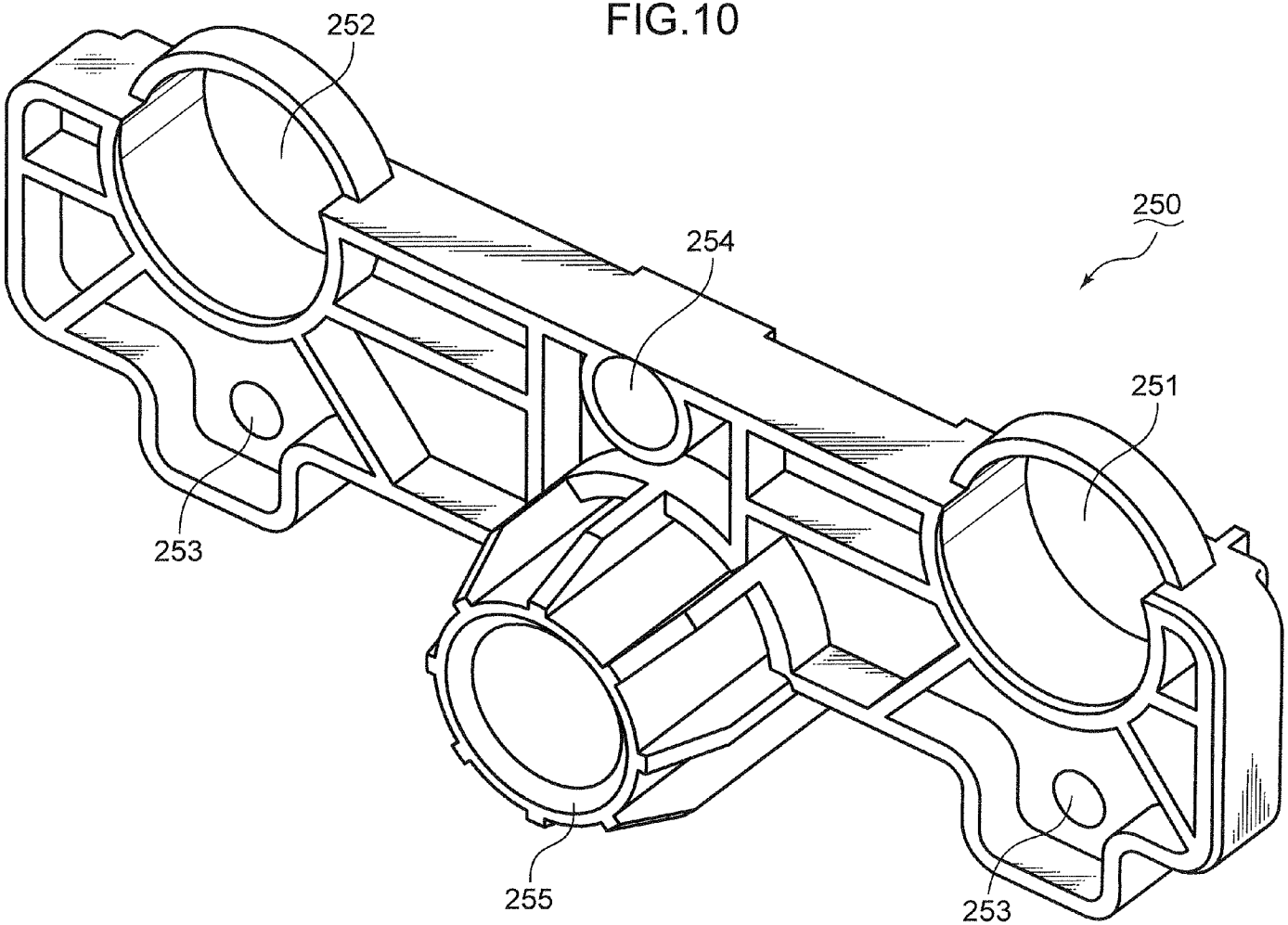
FIG. 10 is a schematic perspective view of a fixing piece configured to fix the exposure device shown in FIG. 8 to the support structure.

FIG. 10 is a schematic perspective view of a fixing piece used for connecting the exposure device 200 to the first frame plate 320. The connection of the exposure device 200 to the first frame plate 320 is described with reference to FIGS. 2, 5 and 8 to 10.

The exposure device 200 is inserted into the support frame 300 from above. As a result, the first and second bosses 213, 214 are inserted into the notches 326 defined in the first frame plate 320.

The copier 100 further comprises a substantially rectangular fixing piece 250. The exposure device 200, which is inserted into the support frame 300, is fixed to the support frame 300 by the fixing piece 250. The fixing piece 250 is provided with a first hole 251 complementary to the first boss 213 and a second hole 252 complementary to the second boss 214.

The tip of the first boss 213 attached to the first frame plate 320 is inserted into the first hole 251. The second boss 214 attached to the first frame plate 320 is inserted into the second hole 252.

Through-holes 253 are defined in the fixing piece 250. The first frame plate 320 may have screw holes 328 that communicate with the paired through-holes 253 below the first and second holes 251, 252. The user may insert screws or another appropriate fixture into the through-holes 253 and screw them with the screw holes 328 of the first frame plate 320. As a result, the fixing piece 250 is fixed to the first frame plate 320 to appropriately restrict a vertical movement of the exposure device 200.

A through-hole 254 is also defined in substantially an intermediate position between the first and second holes 251, 252. The through-hole 254 communicates with the attachment hole 215 defined in the front wall 211 of the exposure device 200. The user may insert a screw or other appropriate fixture into the attachment hole 215 through the through-hole 254. Accordingly, the fixing piece 250, the first frame plate 320 and the exposure device 200 may be coupled to one another.

The fixing piece 250 includes a substantially cylindrical projection tube 255. The internal space of the projection tube 255 communicates with the adjustment hole 216 defined in the front wall 211 of the exposure device 200. The user may insert a dedicated tool into the projection tube 255 to adjust the optical devices of the exposure device 200.

Figure 11:
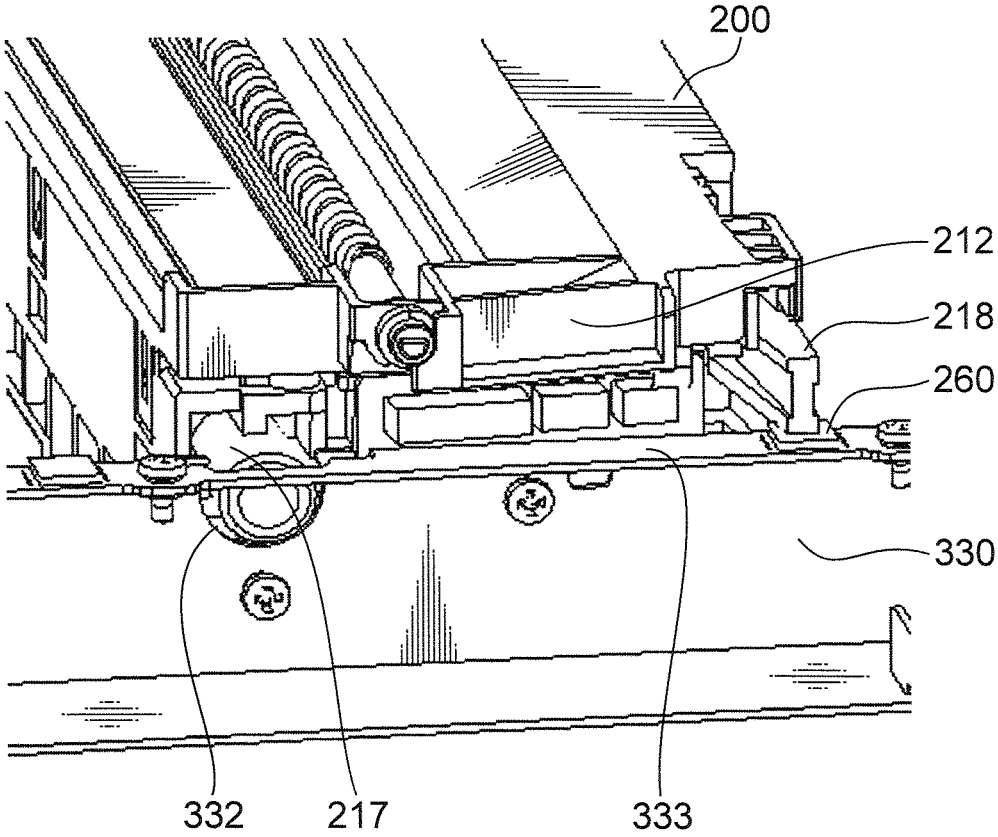
FIG. 11 is a schematic perspective view of a connection between the exposure device shown in FIG. 8 and the support structure.

FIG. 11 is a perspective view of a connection structure between the exposure device 200 and the second frame plate 330. The connection between the exposure device 200 and the second frame plate 330 is described with reference to FIGS. 2, 9 and 11.

The back wall 212 of the exposure device 200 includes a cylindrical third boss 217 protruding toward the second frame plate 330. The second frame plate 330 is provided with a notch 332 complementary to the lower portion of the third boss 217. The third boss 217 substantially opposite to the first boss 213 is inserted into the notch 332 defined in the second frame plate 330. The third boss 217 engages with the notch 332 to support the exposure device 200 on the second frame plate 330. In the present embodiment, the third boss 217 is exemplified as the second protrusion. The notch 332 is exemplified as the second notch.

The back wall 212 further comprises an arm 218 protruding toward the second frame plate 330. The arm 218 is substantially opposite to the second boss 214. The arm 218 extends along the upper edge surface 333 of the second frame plate 330.

The copier 100 further comprises a cushion 260. The cushion 260 is placed on the upper edge surface 333 of the second frame plate 330. The arm 218 is mounted on the cushion 260. For example, a rubber plate piece is suitably used as the cushion 260.

Figure 12:
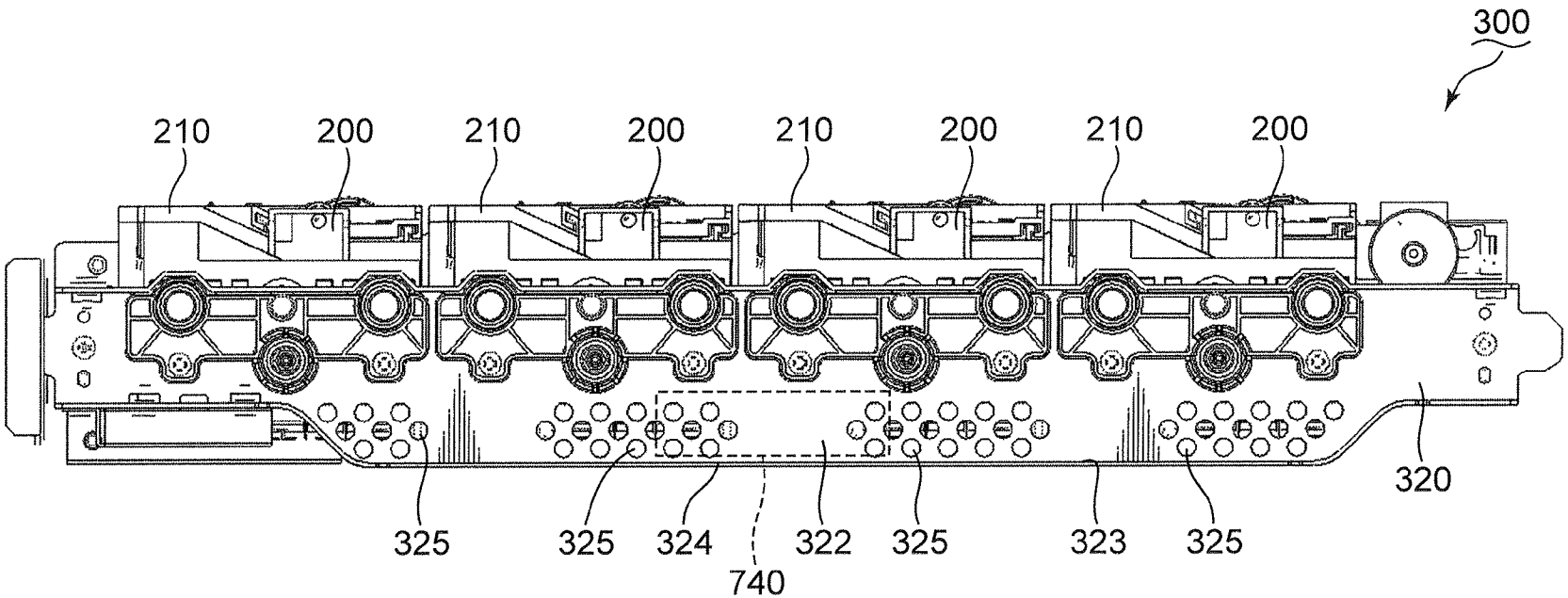
FIG. 12 is a schematic front view of the support structure configured to support the exposure device shown in FIG. 2.

FIG. 12 is a schematic front view of the support frame 300. Cooling operation for the exposure device 200 is described with reference to FIGS. 3, 5, 6 and 12. The following descriptions of the first frame plate 320 are applied to the second frame plate 330 as well.

The exposure device 200 typically comprises a light source (not shown) which generates a laser beam, and a motor (not shown) which rotates a polygon mirror for scanning the circumferential surface of the photosensitive drum 410 with the laser beam. The exposure device 200 may include the same optical structure as an exposure device used in a well-known image forming apparatus.

As shown in FIG. 6, the exposure device 200 further comprises a heat sink 220 which dissipates heat from the above-mentioned light source or motor outside the housing 210. The heat sink 220 is attached to the bottom surface of the housing 210.

The first frame plate 320 further includes a bump 322 which protrudes downward and a lower strip 323 which is bent outward from the bump 322. While the support frame 300 is inserted into the lower housing 111 or while the support frame 300 is pulled out of the lower housing 111, an outer edge 324 of the lower strip 323 slides on the inner surface 163 of each rib 162 described with reference to FIG. 3, so as to appropriately control the movement of the support frame 300 in the lower housing 111.

The heat from the aforementioned heat sink 220 is dissipated into a space surrounded by the bump 322 of the first frame plate 320, a bump of the second frame plate 330, the support plate 160, and the bottom surface of the housing 210 of the exposure device 200.

The copier 100 may also comprises a blower device 740 such as a fan. The blower device 740 causes airflow in the housing 110 of the copier 100. A lot of perforations 325 are formed in the bump 322. The perforations 325 allow the air to flow in and/or out of the space surrounded by the bump 322 of the first frame plate 320, the bump of the second frame plate 330, the support plate 160, and the bottom surface of the housing 210 of the exposure device 200, which results in efficient heat dissipation from the exposure device 200. In the present embodiment, the blower device 740 is exemplified as the blower.

Figure 13:
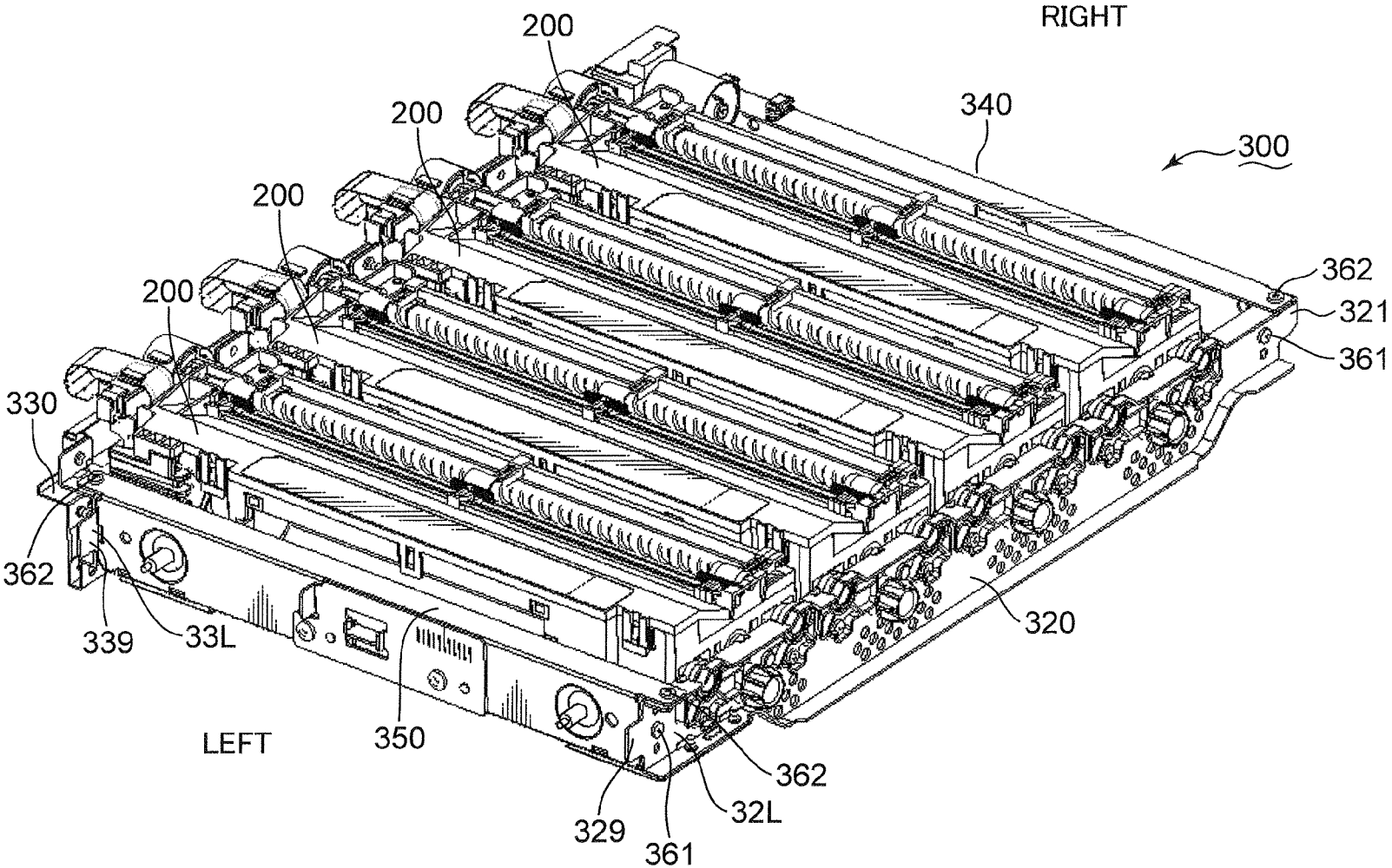
FIG. 13 is a schematic perspective view of the support structure configured to support the exposure device shown in FIG. 2.

FIG. 13 is a schematic perspective view of the support frame 300 which supports the exposure device 200. The support frame 300 is further described with reference to FIGS. 5 and 13.

The support frame 300 further comprises a fourth frame plate 350 opposite to the third frame plate 340. The fourth frame plate 350 is connected to a left end 32L of the first frame plate 320 and a left end 33L of the second frame plate 330. In the present embodiment, the left ends 32L, 33L of the first and second frame plates 320, 330 are exemplified as the second ends, respectively.

The first frame plate 320 is connected to the fourth frame plate 350 by means of a single horizontal screw 361, which is horizontally fitted, and a single vertical screw 362 which is vertically fitted. Likewise, the first frame plate 320 is connected to the third frame plate 340 by means of a single horizontal screw 361, which is horizontally fitted, and a single vertical screw 362, which is vertically fitted.

The second frame plate 330 is connected to the fourth frame plate 350 by means of a single horizontal screw 361, which is horizontally fitted, and a single vertical screw 362, which is vertically fitted. Likewise, the second frame plate 330 is connected to the third frame plate 340 by means of a single horizontal screw 361, which is horizontally fitted, and a single vertical screw 362, which is vertically fitted.

In order to insert the horizontal and vertical screws 361, 362, small displacement of the first, second, third and/or fourth frame plates 320, 330, 340, 350, which is caused by the weight of the exposure device 200 that is supported by the support frame 300, is allowed by a tolerance of a through-hole that is formed in the first, second, third and/or fourth frame plates 320, 330, 340, 350. Therefore, the support frame 300 may be deformed by the weight of the exposure device 200 to follow the shape of the housing 110 of the copier 100.

Figure 14:
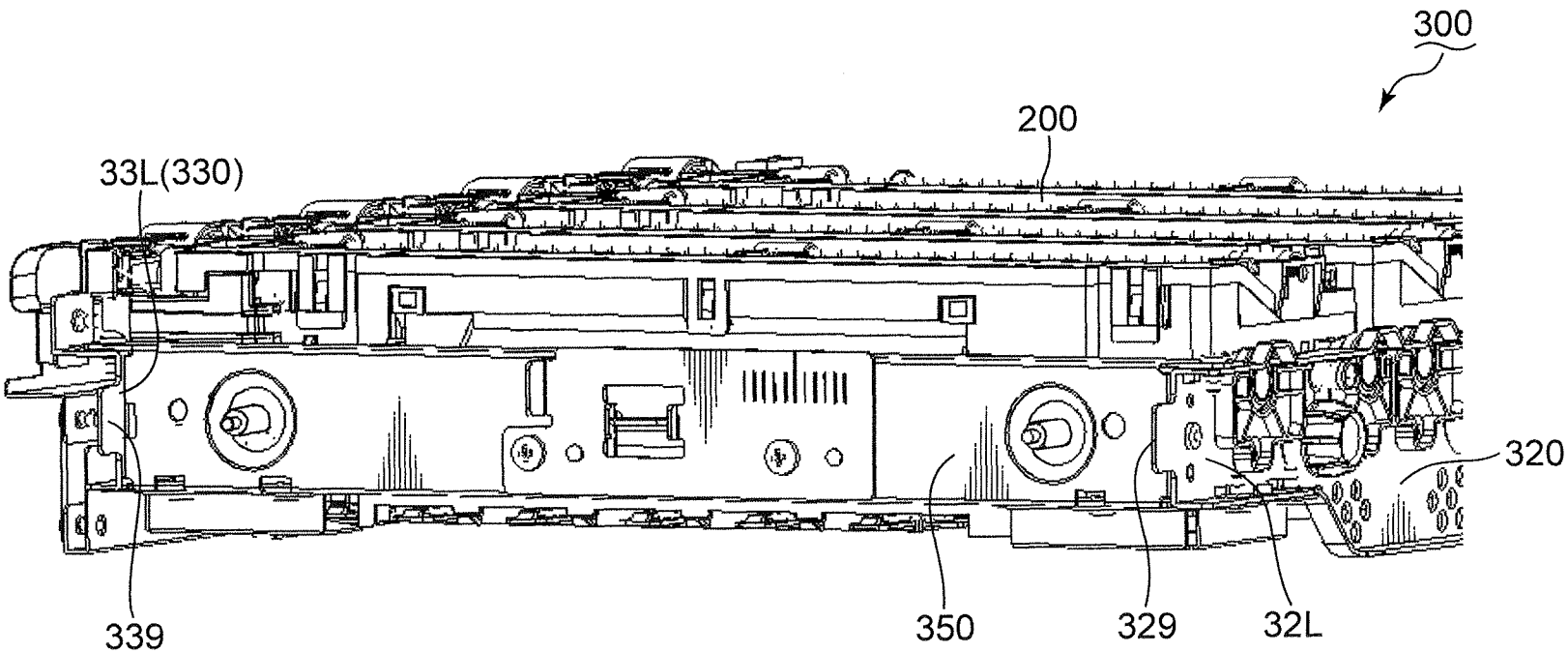
FIG. 14 is a schematic perspective view of the support structure configured to support the exposure device shown in FIG. 2.
Figure 15:
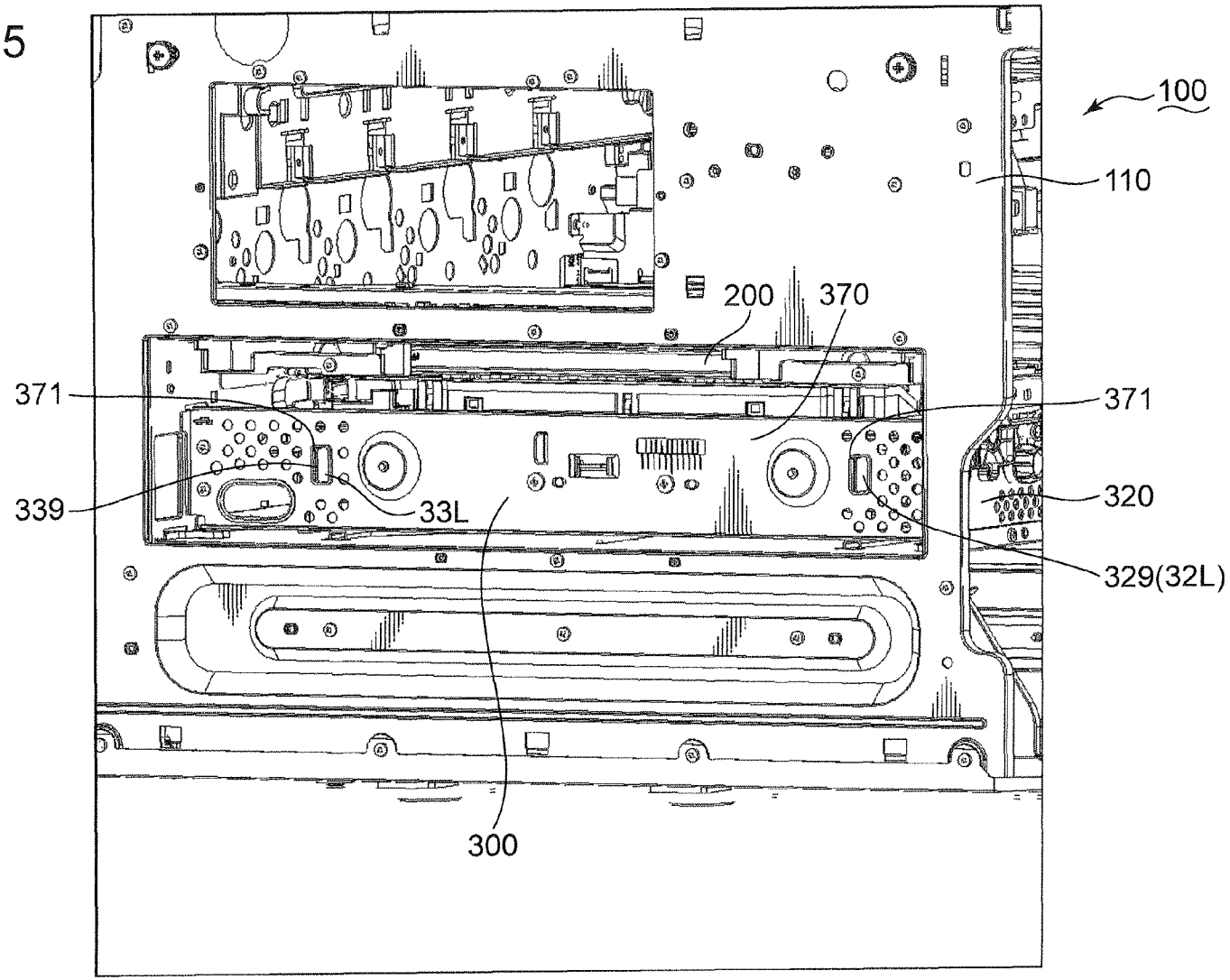
FIG. 15 is a schematic perspective view of the support structure configured to support the exposure device shown in FIG. 2.

FIG. 14 is a schematic perspective view of the support frame 300 which supports the exposure device 200. FIG. 15 is a schematic perspective view of the support frame 300 stored in the housing 110 of the copier 100. The support frame 300 is further described with reference to FIGS. 5, 7 and 13 to 15.

The first frame plate 320 includes a flap 329 projecting from the fourth frame plate 350. Likewise, the second frame plate 330 includes a flap 339 projecting from the fourth frame plate 350. The support frame 300 further includes an attachment plate 370 adjacent to the fourth frame plate 350. The attachment plate 370 is provided with slits 371. The flap 339 projects from the attachment plate 370 through one of the slits 371. In the present embodiment, the flaps 329, 339 at the left ends 32L, 33L of the first and second frame plates 320, 330 are exemplified as the insertion pieces, respectively. The slits 371, into which the flaps 329, 339 are inserted, are exemplified as insertion holes. The contour of each slit 371 is exemplified as the second hole edge.

As described above, the support frame 300 is deformed by the weight of the exposure device 200. Therefore, the flaps 329, 339 are brought into abutment with the lower ends of edges defining the contours of the slits 371. Likewise, the vertical flaps 321, 331 are brought into abutment with the lower ends of edges defining the contours of the vertical slits 311. As shown in FIG. 15, the attachment plate 370 is attached to the housing 110 of the copier 100. Thus, the support frame 300 is appropriately fixed to the housing 110.

Figure 16:
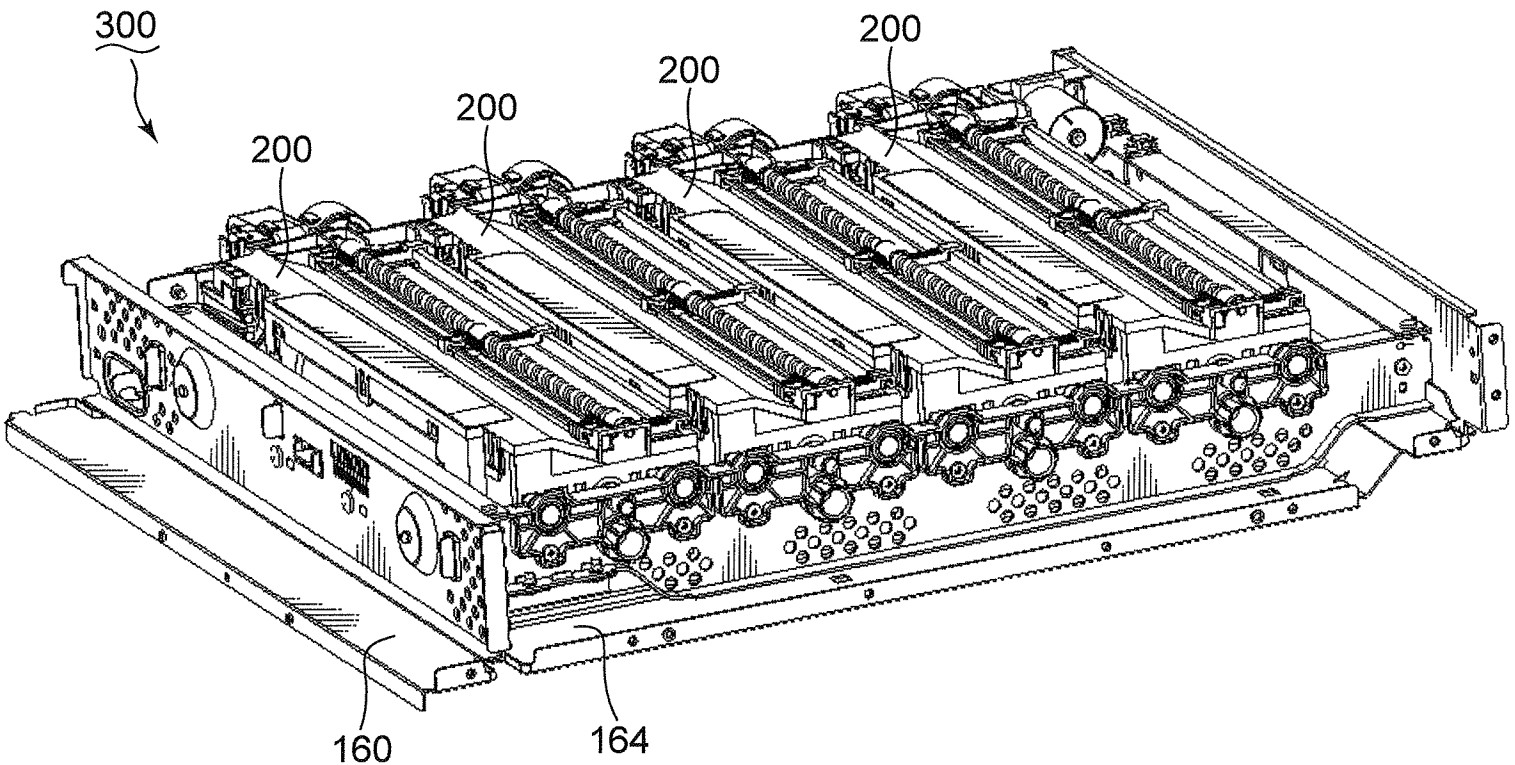
FIG. 16 is a schematic perspective view of the support structure configured to support the exposure device shown in FIG. 2.

FIG. 16 is a schematic perspective view of the support frame 300 placed on the support plate 160. The support frame 300 is further described with reference to FIGS. 4, 5 and 16.

The support frame 300 is slightly deformed by the weight of the exposure device 200, as described above. Therefore, the support frame 300 is appropriately supported by the support plate 160 without separation from the upper surface 164 of the support plate 160.

Parts of a support structure which supports a processing apparatus such as an exposure device that requires highly accurate installation are generally welded to one another. Therefore, the general support structure is fairly rigid. The highly rigid support structure defines a support surface of the processing apparatus by itself. Therefore, the position of the processing apparatus supported by the support structure is defined, not in relation to a housing which stores the processing apparatus, but in relation to the support surface defined by the support structure. This causes a displacement of a relative position between the processing apparatus and another device which is stored in the housing storing the processing apparatus.

In the present embodiment, the support frame 300 is less rigid. Because the support frame 300 is placed along the support plate 160, the position of the exposure device 200 in relation to the photosensitive drum 410 in the housing 110 is appropriately defined.

The support frame 300 is appropriately supported by means of the flaps 329, 339 and the vertical flaps 321, 331, if the support frame 300 is less rigid. If the support frame 300 is supported at four or more points, the support frame 300 is kept stable in the housing 110.

Figure 17:
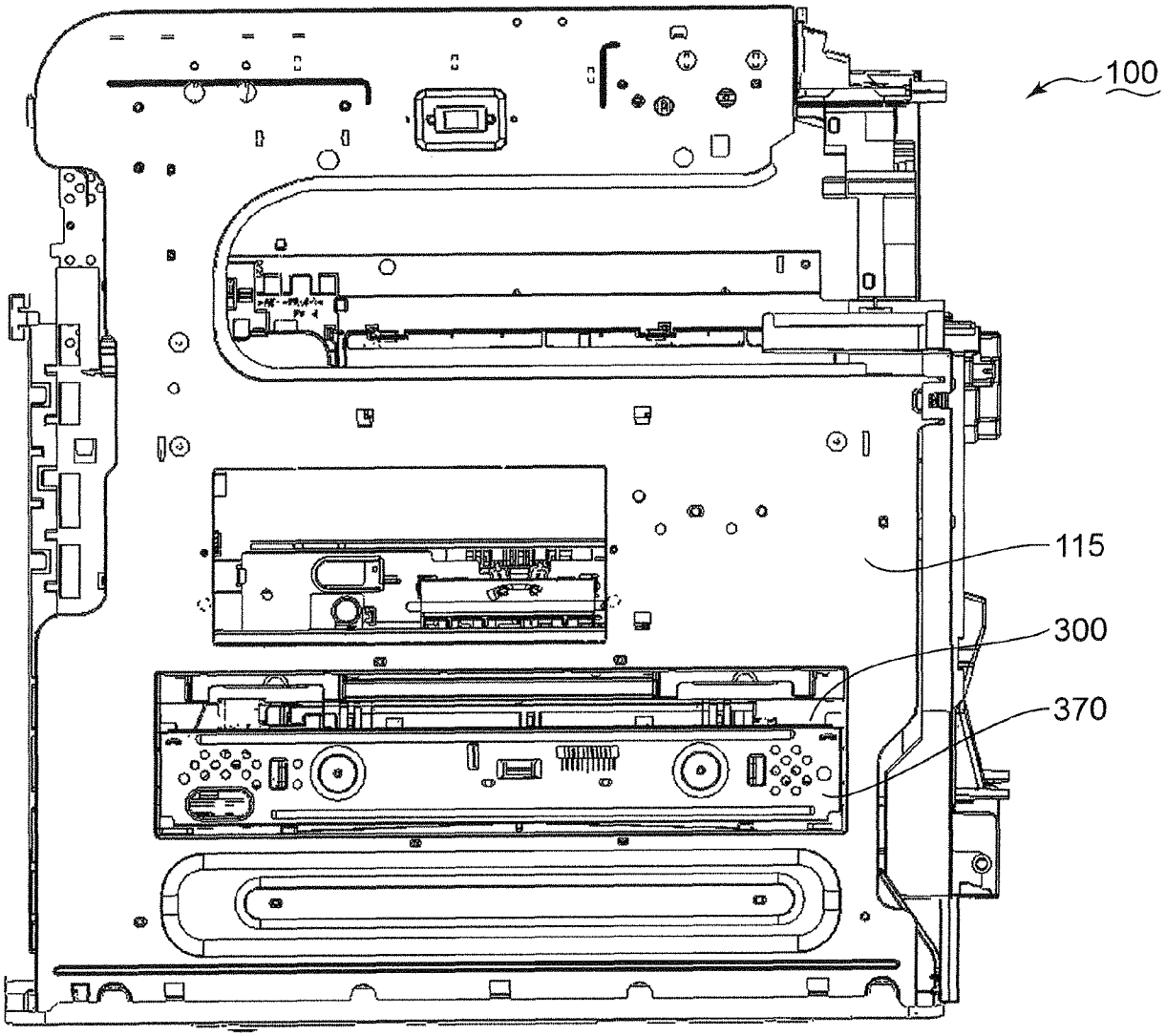
FIG. 17 is a schematic left side view of the image forming apparatus shown in FIG. 1.

FIG. 17 is a schematic left side view of the copier 100. The support frame 300 is further described with reference to FIGS. 5 and 17.

The attachment plate 370 adjacent to the fourth frame plate 350 is connected to the housing 110.

Figure 18:
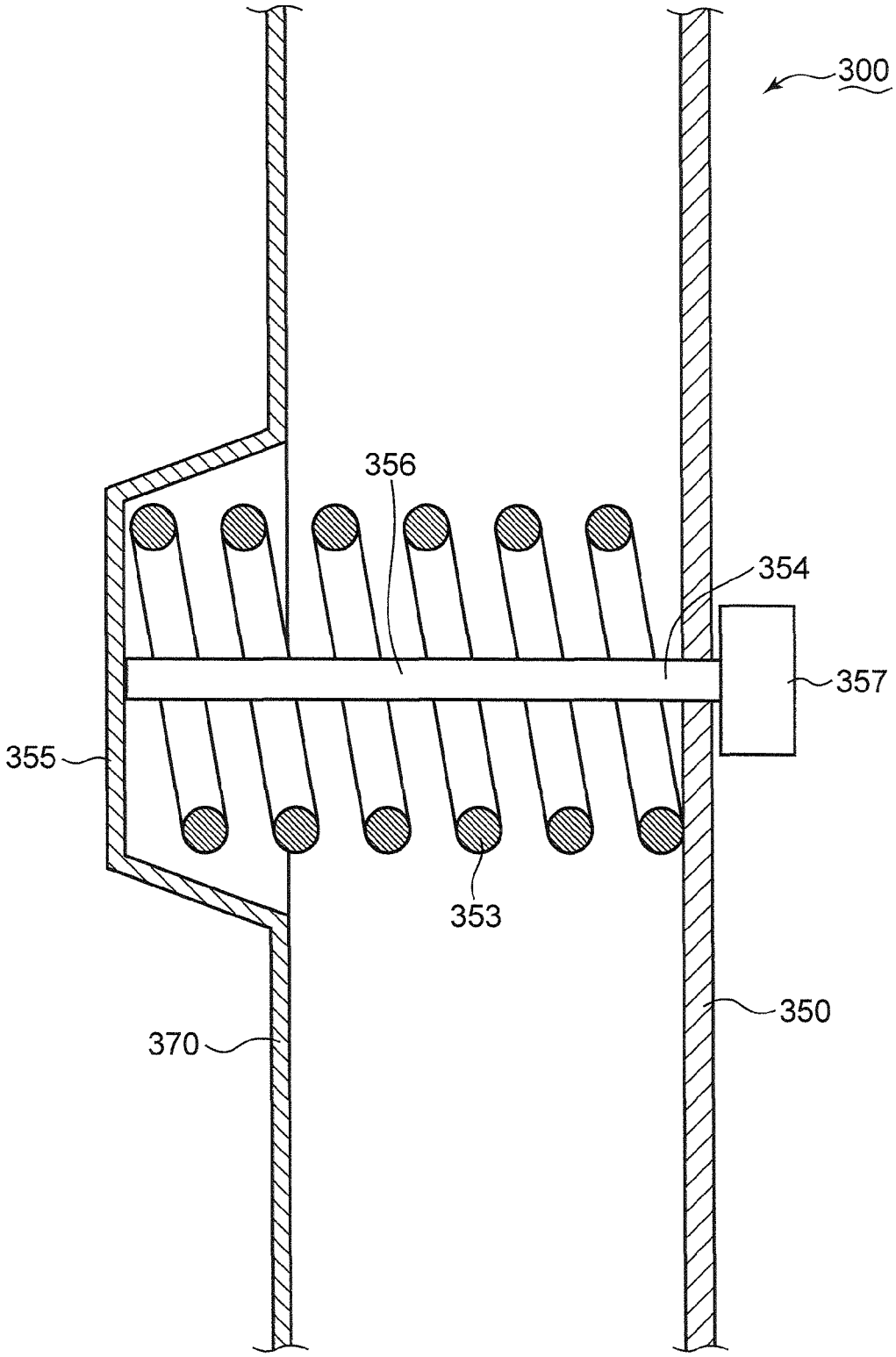
FIG. 18 is a schematic view of a connection between attachment plate and the fourth frame plate of the support structure shown in FIG. 12.

FIG. 18 is a cross-sectional view, which schematically showing a connection between the attachment plate 370 and the fourth frame plate 350. The connection between the attachment plate 370 and the fourth frame plate 350 is described with reference to FIGS. 5, 7 and 18.

The support frame 300 further comprises coil springs 353 situated between the attachment plate 370 and the fourth frame plate 350, and a header pin 354 extending along the central axes of the coil springs 353. The attachment plate 370 includes a dish-like spring seat 355 projecting to the left. The header pin 354 includes a trunk 356 attached to the spring seat 355, and a head 357 at a tip of the trunk 356. The trunk 356 of the header pin 354 is brought into abutment with the spring seat 355. The coil springs 353, which are wound around the trunk 356 of the header pin 354, bias the fourth frame plate 350 toward the positioning wall 310. Therefore, the vertical and horizontal flaps 321, 341 are tightly pushed into the vertical and horizontal slits 311, 312, respectively. Thus, the support frame 300 is appropriately positioned with respect to the housing 110. In the present embodiment, the coil springs 353 are exemplified as biasing elements.

The principles of the aforementioned embodiment may be applied to other apparatuses than image forming apparatuses. In the aforementioned embodiment, the copier 100 is exemplified as the processing apparatus, and the exposure device 200 is exemplified as the processing unit. Another processing apparatus configured to perform predetermined processes may be used instead of the exposure device 200.

This application is based on Japanese Patent applications Nos. 2011-014303 and 2011-018285 filed in Japan Patent Office on Jan. 26, 2011 and Jan. 31, 2011, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

What is claimed is:

1. An image forming apparatus for forming an image on a sheet, comprising:

an exposure device configured to emit light to a charged image formation surface to form an electrostatic latent image;

a support structure configured to support the exposure device; and a housing configured to store the exposure device, wherein the housing includes a first wall that is provided with an insertion opening to insert the support structure that supports the exposure device, and a second wall that faces the first wall, the support structure is designed so that the support structure is pulled out of the housing through the insertion opening and includes a first frame plate that extends in an insertion direction of the support structure, a second frame plate opposite to the first frame plate, a third frame plate that is connected to the first and second frame plates, an attachment plate attached to the housing, a fourth frame plate situated between the attachment plate and the exposure device, and a biasing element situated between the attachment plate and the fourth frame plate, the fourth frame plate is opposite to the third frame plate and is connected to the first and second frame plates, and the biasing element pushes the fourth frame plate toward the second wall.

2. The image forming apparatus according to claim 1, wherein the exposure device is supported between the first and second frame plates, each of the first and second frame plates includes a first positioning piece, and the second wall includes an inner wall surface that is provided with two first positioning holes to insert the first positioning pieces.

3. The image forming apparatus according to claim 2, wherein the third frame plate includes a second positioning piece, and the inner wall surface of the second wall is provided with a second positioning hole in to which the second positioning piece is inserted.

4. The image forming apparatus according to claim 3, wherein the first positioning hole is a slit which extends in a vertical direction, and the second positioning hole is a slit which extends in a horizontal direction.

5. The image forming apparatus according to claim 2, further comprising a blower mounted in the housing and configured to cause an airflow in the housing, wherein each of the first and second frame plates is provided with perforations to allow the airflow.

6. The image forming apparatus according to claim 2, wherein the exposure device includes a first exposure device and a second exposure device separate from the first exposure device, and the first and second exposure devices are independently mounted between the first and second frame plates.

7. The image forming apparatus according to claim 1, wherein the housing includes a support surface which supports the support structure, the support surface is provided with a rail which extends in the insertion direction of the support structure, and the rail guides the support structure to move in the insertion direction or a pull-out direction.

8. The image forming apparatus according to claim 6, wherein the support structure is deformed by a weight of the exposure device.

9. The image forming apparatus according to claim 8, wherein each of the first and second frame plates includes an insertion piece formed at a second end opposite to a first end at which the first positioning piece is formed, and the attachment plate is provided with two insertion holes to insert the insertion pieces.

10. The image forming apparatus according to claim 9, wherein the first positioning pieces are brought into abutment with first hole edges that define contours of the first positioning holes, and the insertion pieces are brought into abutment with second hole edges that define contours of the insertion hole.

11. The image forming apparatus according to claim 10, wherein the first and second frame plates are connected displaceably to the third frame plate so that the first and second frame plates are displaceable with respect to the third frame plate by the weight of the exposure device that is supported by the first and second frame plates.

12. The image forming apparatus according to claim 11, wherein the fourth frame plate is connected to the second ends of the first and second frame plates, and the first and second frame plates are connected displaceably to the fourth frame plate so that the first and second frame plates are displaceable with respect to the fourth frame plate by the weight of the exposure device which is supported by the first and second frame plates.

13. The image forming apparatus according to claim 8, wherein the exposure device includes a storage box which stores an optical device to scan the image formation surface with the light, the storage box includes a cylindrical first protrusion which protrudes toward the first frame plate, the first frame plate is provided with a first notch complementary to the first protrusion, and the first protrusion engages with the first notch to support the exposure device on the first frame plate.

14. The image forming apparatus according to claim 13, wherein the storage box includes a cylindrical second protrusion which protrudes toward the second frame plate, the second frame plate is provided with a second notch complementary to the second protrusion, and the second protrusion engages with the second notch to support the exposure device on the second frame plate.

15. The image forming apparatus according to claim 1, wherein the biasing element includes a coil spring, the support structure includes a header pin extending along a central axis of the coil spring, the header pin includes a trunk surrounded by the coil spring and a head thicker than the trunk, the fourth frame plate is sandwiched by the coil spring and the head.

16. The image forming apparatus according to claim 1, further comprising:

a single first horizontal screw and a single first vertical screw that are inserted into the third frame plate horizontally and vertically, respectively, to connect the third frame plate to the first frame plate, a single second horizontal screw and a single second vertical screw that are inserted into the third frame plate horizontally and vertically, respectively, to connect the third frame plate to the second frame plate, a single third horizontal screw and a single third vertical screw that are inserted into the fourth frame plate horizontally and vertically, respectively, to connect the fourth frame plate to the first frame plate, and a single fourth horizontal screw and a single fourth vertical screw that are inserted into the fourth frame plate horizontally and vertically, respectively, to connect the fourth frame plate to the second frame plate.

* * * * *